US005293355A

United States Patent [19]

Widen et al.

[11] Patent Number: 5,293,355

[45] Date of Patent: Mar. 8, 1994

[54] TIDAL WATCH

[75] Inventors: Randy M. Widen, 4 Elkins La., Lusby, Md. 20657; Lance Stiles, Churchville, Va.

[73] Assignee: Randy M. Widen, Lusby, Md.

[21] Appl. No.: 604,481

[22] Filed: Oct. 26, 1990

[51] Int. Cl.[5] ..... G04B 19/26

[52] U.S. Cl. ..... 368/19

[58] Field of Search ..... 368/19

[56] References Cited

U.S. PATENT DOCUMENTS 3,745,313 7/1973 Spilhaus ..... 368/19

3,982,104 9/1976 Banner ..... 368/19

FOREIGN PATENT DOCUMENTS 010259 9/1990 World Int. Prop. O. ..... 368/19

*Primary Examiner*—Bernard Roskoski

*Attorney, Agent, or Firm*—Spencer, Frank & Schneider

[57] ABSTRACT

A time keeping device, including an integrated circuit memory containing tide table data, having the ability to provide custom port information using user supplied offsets. The device provides a tide prediction system to predict and display the times of high and low tides for numerous ports and adjacent areas spanning, for example, the East, West, and Gulf Coast regions of the continental U.S. The device allows the setting and display of the different Port/Substations supported by the tide prediction system, displays the current time, date, and day of the week in standard or military format (24 hour clock), and adjusts for Daylight Saving time. Displays are provided for the phases of the moon from New to Full and back to New Moon, indicating whether it is waxing or waning, and for the current water level height An audible alarm may be generated for the arrival of a new hour, arrival of the next tidal event, or the arrival of a time preset by the user, and the device may also function as a stop watch. The user of the device may establish a plurality of Custom Ports by setting time offsets for high and low tidal events relative to any tidal port supported by the system.

24 Claims, 23 Drawing Sheets

ENTITY-RELATIONSHIP DIAGRAM

FIG. 11

TIME BETWEEN TIDES { TENS OF MINUTES }

| PORT | MAXIMUM | MINIMUM | AVERAGE |
|---|---|---|---|
| HAMPTON | 41 | 34 | 37.260 |
| BREAKWATER | 42 | 33 | 37.260 |
| BRIDGEPORT | 40 | 35 | 37.260 |
| EASTPORT | 40 | 35 | 37.261 |
| MAYPORT | 42 | 32 | 37.260 |
| MIAMI | 40 | 34 | 37.259 |
| NEW LONDON | 44 | 32 | 37.259 |
| NEW YORK | 44 | 30 | 37.261 |
| PORTLAND | 40 | 34 | 37.260 |
| REEDY PT | 45 | 30 | 37.263 |
| SAVANNA | 43 | 31 | 37.259 |
| SAVANNA RIVER | 41 | 32 | 37.260 |
| WASHINGTON,DC | 48 | 29 | 37.258 |
| WILLETS PT | 45 | 32 | 37.261 |
| WILMINGTON | 47 | 27 | 37.257 |
| BOSTON | 40 | 34 | 37.260 |
| CHARLESTON | 40 | 33 | 37.259 |
| SANDY HOOK | 41 | 33 | 37.260 |
| PHILADELPHIA | 47 | 29 | 37.263 |
| ALBANY | 44 | 29 | 37.259 |
| NEWPORT | 47 | 29 | 37.260 |
| ABERDEEN | 46 | 28 | 37.262 |
| KEY WEST | 49 | 15 | 37.257 |
| BALTIMORE | 47 | 23 | 37.262 |
| SAN FRANCISCO | 52 | 15 | 37.258 |
| SEATTLE | 51 | 21 | 37.249 |
| HUMBOLDT | 48 | 20 | 37.261 |
| ASTORIA | 48 | 26 | 37.261 |
| MOBILE | 101 | 13 | 67.931 |
| PENSACOLA | 101 | 13 | 69.924 |
| ST MARKS | 96 | 13 | 37.414 |
| ST PETERSBURG | 101 | 12 | 47.243 |
| GALVESTON | 98 | 12 | 46.257 |
| LOS ANGELES | 101 | 12 | 38.124 |
| PORT TOWNSEND | 102 | 12 | 38.741 |
| SAN DIEGO | 102 | 12 | 37.849 |

TIDAL WATCH

BACKGROUND OF THE INVENTION

1. Field of the Invention

The invention relates to the field of electronic timing devices, and more particularly, to a tide prediction apparatus and method in a compact, portable and/or hand-held tide predicting watch.

2. Background Information

Navigators, fishermen, yachtsmen and shore dwellers everywhere have a need for accurate information concerning the prediction of tides Small craft and cabin cruisers using inland waters need to know the tide and the time it will occur so that they may safely travel without the hazards of low water making navigation treacherous.

By around 1650, it was generally accepted that the movements of the tides were connected with the Moon. Lunar tides are the effect of the Moon's gravitational pull acting on water on the surface of the Earth. The Sun's gravity also has an effect, but less than half that of the Moon's. The magnitude and time lag of the response of the water on the Earth to the pull of the Sun, Moon and other tide generating forces, varies according to terrestrial conditions, such as the depth, shape and size of the sea in a particular tidal area. Spring tides occur when the Sun and Moon are in conjunction (New Moon) or opposition (Full Moon). With these tides, the height and range of the tides is greater than at other times. Neap tides occur when the Sun and Moon are in quadrature, acting at right angles to each other. Neap tides have higher low water and lower high water than average with a range that is smaller than at other times. Perigee and Apogee tides occur because the Moons orbit is elliptical so that its distance from the Earth varies during the month. At Perigee the Moon is closest and at Apogee farthest from the Earth. Meterological and geographic conditions cause differences between the tides predicted on the basis of the forces described above and actual tides. Winds and barometric pressure changes, due to storms for instance, cause variations in the height of the tides. River estuaries and narrow tide channels also affect tidal profiles. Because of the multitude of effects, it is important to have the most accurate and up to date tidal predictions science can provide.

Around 1830, the first tide predictions for the United States were published in The American Almanac. In 1883, William Ferrel introduced the Maxima and Minima Tide Predictor. This machine summed nineteen constituents, e.g., a harmonic element of the tide generating force derived from the relative positions of the Earth, Moon and Sun. This machine predicted high and low tides from 1885 to 1914.

In 1912, Rollin A. Harris and E. G. Fischer produced an analog machine that summed 37 constituents. The National Oceanic and Atmospheric Administration (NOAA) used this machine, known as "Old Brass Brains" from 1912 through 1965. Presently NOAA displays it in its headquarters in Washington, D.C.

In 1965, analog to digital tide gauges were introduced. In 1966, electronic digital computers began to compute all constituents as described in the Manual of Harmonic Analysis and Prediction of Tides, U.S. Coast and Geodetic Survey.

The output of NOAA's computers, plus local secondary offset observations and constants, creates their published Tide Table predictions, which appear daily in almost all newspapers published within 150 miles of the Atlantic, Pacific and Gulf of Mexico coast lines, and in numerous almanacs and smaller publications of local interest. Both the radio and TV media broadcast tide times throughout the day. The end users of this information are coastal pilots, small and large power or sail boaters, fishermen, both recreational and commercial, coastal residents, marine engineers, skin and scuba divers, beachcombers, and others with an interest in marine or nautical oriented activities. The tide tables produced by NOAA give good accuracy, but are inconvenient to use. Usually, one has to look up the primary Reference Station, correct for Daylight Savings Time, look in the back for published offsets, and then determine the predicted tide at a station near your location Computer programs exist for home use on home computers to predict tides using average times between tides, and there are some portable tide predicting devices available. These existing systems have various drawbacks and limitations.

Banner, U.S. Pat. No. 3,982,104 discloses a time and tide calculating device for wrist watches, clocks and calculators that registers the tides and the time of the tides, comprising rotatable concentric tide and calender discs placed adjacent to a clock face for indicative registration and cooperation with time telling devices. These mechanical discs are rotated and tide data indicated by markings on the discs. This device relies on an average tide occurrence lag of 50 minutes each day, which makes it inaccurate since the "time lag" varies each day, sometimes being greater and sometimes less than the average. This average is based on the idea that tides follow the Moon slavishly, and ignores other effects In fact, the interval which the Moon takes to appear to circle the Earth increases and decreases as the lunar month progresses. Also, changing locations requires resetting the device or renders it useless. For instance, at Galveston, Tex., tide tables reveal that usually there are two high and low tides per day, but that sometimes only one high and one low tide occur per day. The intervals from day to day vary from a few minutes to nearly two hours. Hence, tide predictions using this device have substantial limitations.

Showalter, U.S. Pat. No. 4,412,749 discloses a programmable electronic time and tide clock which displays the real time, whether the next tide will be a high or low tide, and the time the next high or low tide will occur. This device's operation is based on an average time plus a single interval correction between peak high and low tides, with its inherent inaccuracies as mentioned earlier. Changing locations would make the device go completely out of synchronization.

There is known a digital LCD watch with a programmed tide indicator which operates to indicate tide height and rise/fall. It is programmed to indicate future tide conditions for up to 364 days in advance. It has five modes of operation including an alarm mode, a countdown timer mode, a tide set mode in which tide table data is entered into the device manually for day one of a particular month and location, a future tide mode in which, after entering data in the tide set mode described above, one enters a future month day and time to have the tide state and conditions for that future time displayed, and a time set mode for conventional time and calendar setting. The device utilizes a six hour twelve minute cycle which is an average high to low tide interval, and thus is generally inaccurate as mentioned earlier. When a location is changed, this average cycle device becomes completely out of synchronization.

There is also known a tide prediction device which comes in East Coast and West Coast versions. The East Coast version operates through the year 1999 and includes 3076 tide locations and 1416 current locations. The West Coast version operates through the year 2003 and includes 1147 tide locations and 902 current locations Software updates are required to extend the operating life of the device as well as add new tide and current locations when released by NOAA. The device is hand-held and battery operated. It will compute the next high, low, minus, or ebb tide, the next flood or slack current, the height and direction of the tide at any time, and the speed and direction of the current at any time. There is no provision for providing custom ports, i.e., for calculating the tide occurrences at locations offset from the 3076 included in the East Coast version, for instance.

Thus there has been a need for a tide prediction apparatus which is both highly accurate, reflecting true tide values as opposed to average values, and flexible, providing for custom offset locations, to overcome these and other drawbacks present in the existing systems.

SUMMARY OF THE INVENTION

According to the present invention, the above described drawbacks and limitations existent in the field are overcome by providing a highly accurate and flexible time keeping device, including integrated circuit memory containing compressed tide table data, having the ability to provide custom port information using user supplied offsets The realization of the invention accomplishes, among others, the following objects associated with different aspects of the invention.

It is an object of the present invention to provide a tide prediction system which can predict the times of high and low tides for numerous ports and adjacent areas spanning the East, West, and Gulf coast regions of the continental U.S.

It is a further object of the present invention to provide a tide prediction system which allows the setting and display of the different Port/Substations supported by the tide prediction system.

It is a further object of the present invention to provide a tide prediction system which can display the current time, date, and day of the week in standard or military format (24 hour clock), and adjust for Daylight Saving Time.

It is a further object of the present invention to provide a tide prediction system which can display the phases of the moon from New to Full and back to New Moon with a resolution of twelve different phases, and indicate whether it is waxing or waning.

It is a further object of the present invention to provide a tide prediction system which can display the current water level height in stages.

It is a further object of the present invention to provide a tide prediction system which can generate an audible alarm for the arrival of a new hour, arrival of the next change in tide, or the arrival of a time preset by the user.

It is a further object of the present invention to provide a tide prediction system which can function as a stop watch with at least a resolution to hundredths of a second.

It is a further object of the present invention to provide a tide prediction system which allows the user to establish a plurality of Custom Ports by setting time offsets for high and low tidal events relative to any tidal port supported by the system and display graphically the water level associated therewith.

According to one aspect of the invention, published tide table data is efficiently compressed and stored in memory by constructing a plurality of port tables as a chronological list of tidal event entries in units of tens of minutes from the start of a given year with data for adjacent, or similar data pattern, ports stacked in adjacent columns, constructing a group table using the port tables by summing and averaging across rows and padding with null entries where needed, and constructing a database using the group table and rows of offsets for each port in a group.

According to another aspect of the invention, a user inputs offset data for a plurality of Custom Ports, i.e., ports or locations other than those for which there is published data, and the device calculates and displays tide data including a water level indication associated with the desired custom port.

These and other objects and aspects of the invention are better understood with reference to the detailed description and accompanying drawings, and it will be understood that changes in the specific structure shown and described may be made within the scope of the claims without departing from the spirit of the invention.

BRIEF DESCRIPTION OF THE DRAWINGS

FIG. 11 is a list of 36 ports of interest;

DETAILED DESCRIPTION OF THE PREFERRED EMBODIMENT(S)

Figure 1:
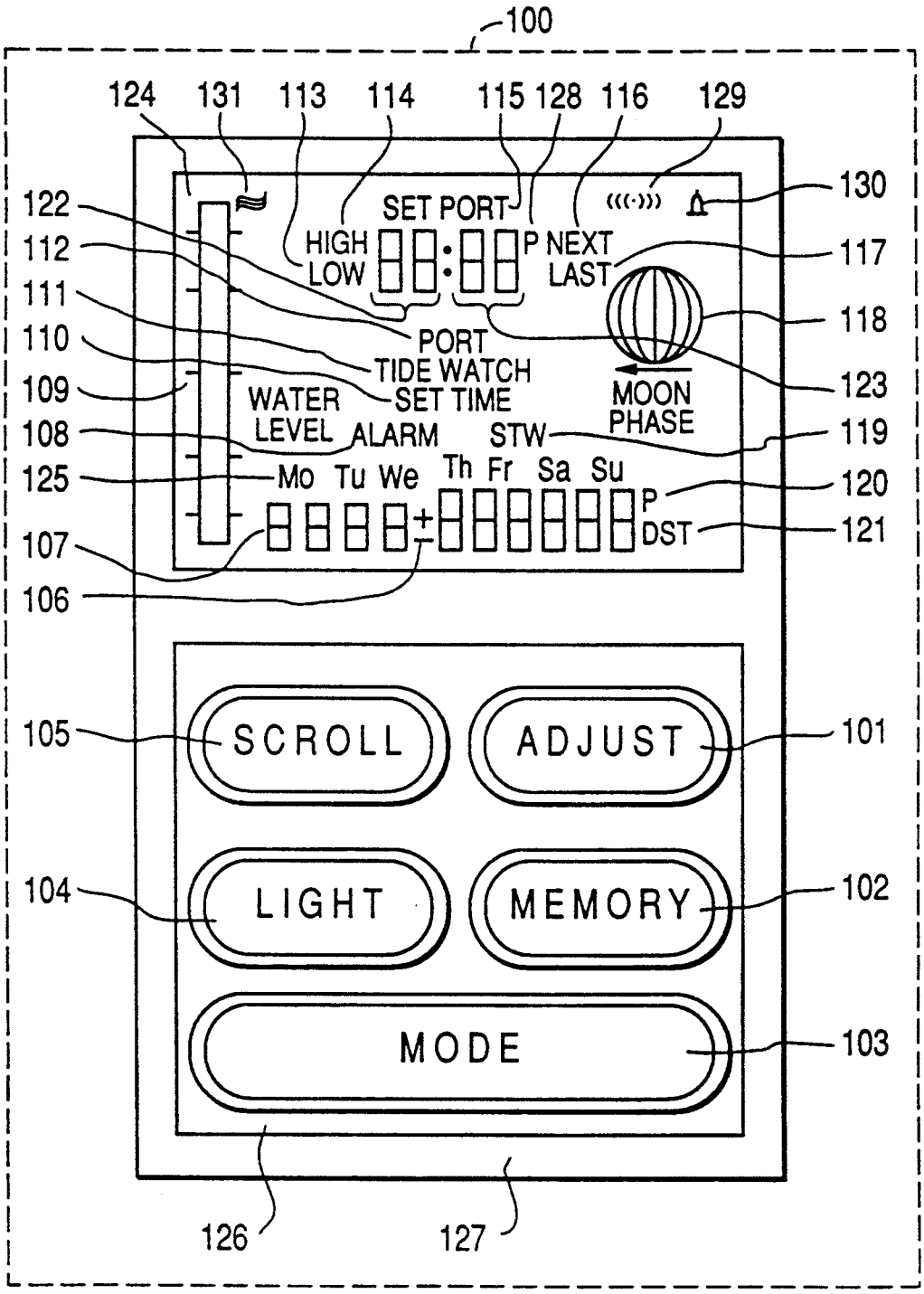
FIG. 1 is an external view of one embodiment of the invention.

FIG. 1 shows an external view 100 of an embodiment of the invention. Display area 124 and key-pad area 126 are located on case 127 as shown. The case 127 encloses the internal components (not shown) and protects them from environmental contaminants, such as dust and moisture. Switches 101–105 in key-pad area 126 include switches which control various functions of the embodiment, "adjust" 101, "memory" 102, "mode" 103, and "scroll" 105, and switch "light" 104 which controls the brightness of the display area 124 so that a user may adjust the display for different ambient light conditions.

Display area 124 includes areas 106–123 for displaying a variety of data to a user. Among these are: graphic water level display 109; Tide Change Alarm icon 131; Time Alarm icon 129; Hour Chime icon 103; moon phase display 118; port 112, high 114 and low 113 tide, set port 115, numerical hour and minute segments 122 and 123, next 116 and last 117 displays; date display area including segments 107, plus/minus 106, Daylight Savings Time (DST) 121, day of week (Mo Tu We Th Fr Sa and Su) 125; alarm prompt 108; stop watch (STW) 119; P.M. indicators (P) 120 and 128; set time 110; and tidewatch 111. The graphic water level display 109 operates using the rule of twelfths.

Figure 2:
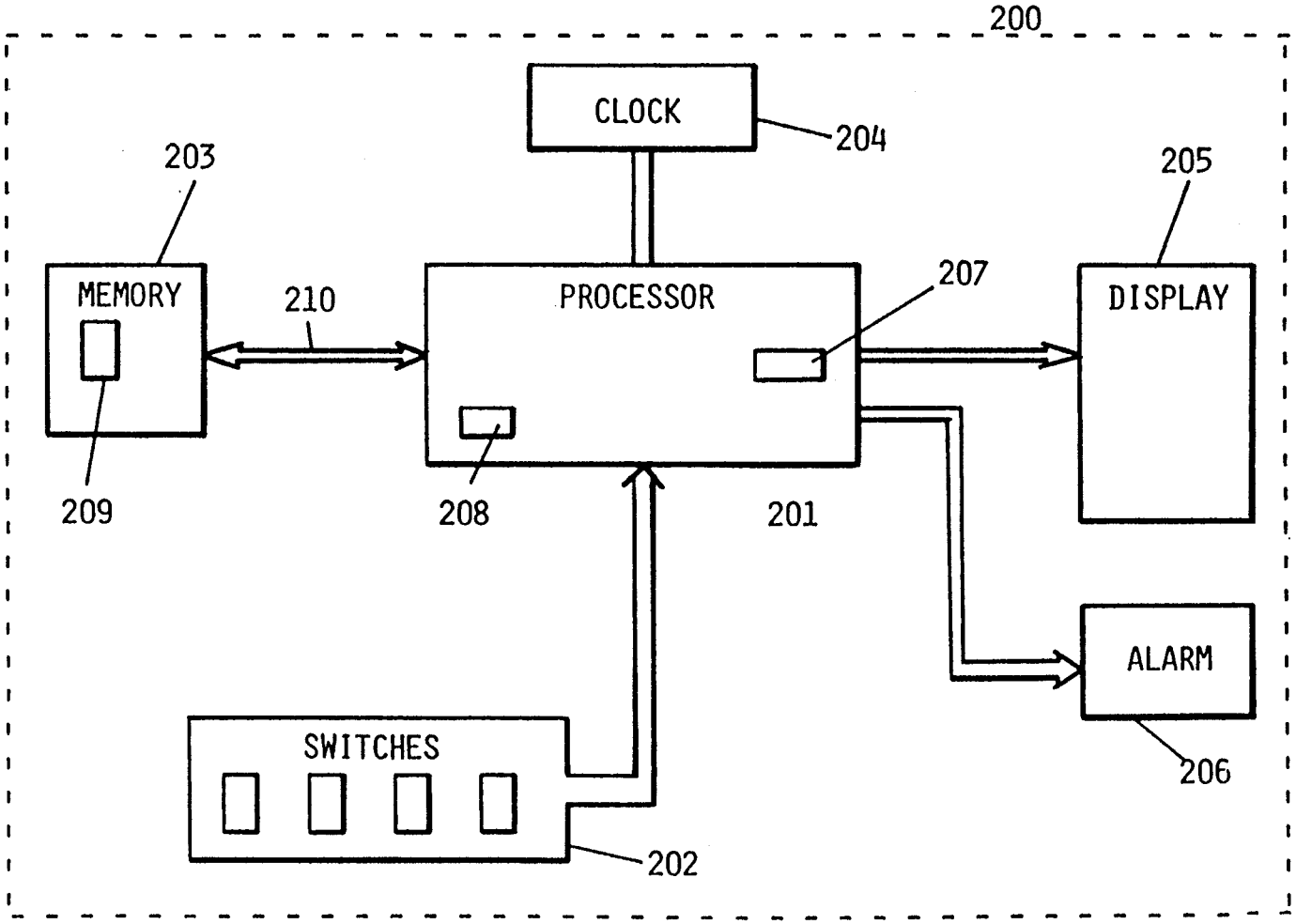
FIG. 2 is a block diagram of the major hardware components of an embodiment of the invention.
Figure 3:
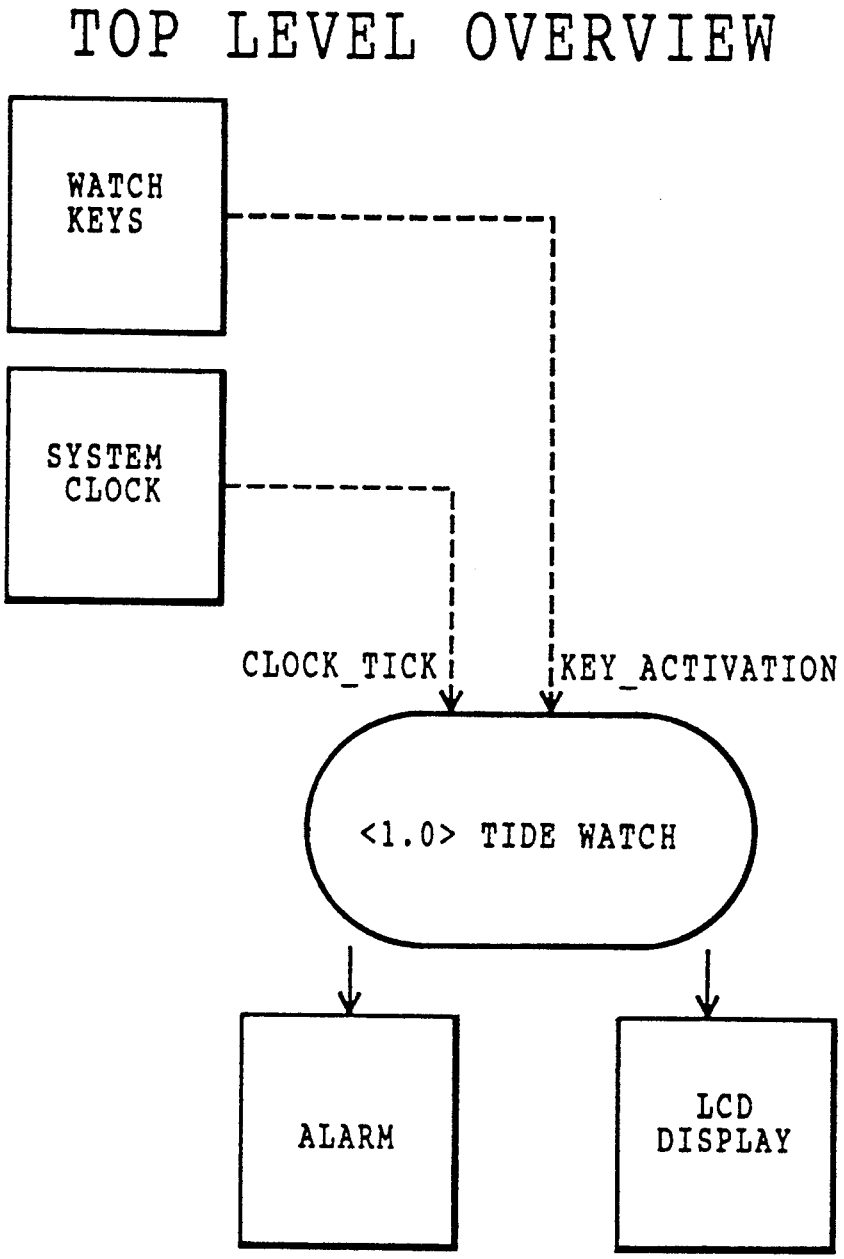
FIGS. 3 to 8 together are the dataflow diagrams for one embodiment of the invention.

A block diagram 200 of the major hardware components is shown in FIG. 2. Processor 201 controls the operation of the device. It controls custom LCD display 205, which may be configured as display area 124 shown in FIG. 1, and includes an on-board LCD display driver 207. Four switches are depicted in block 202, and correspond to switches 101, 102, 103 and 105 in FIG. 1. These switches 202 signal processor 201 to exit the Halt mode and execute associated appropriate program code stored in the processor's 201 internal memory 208. External to the processor 201 is memory 203, which may be static RAM, for containing port tide database 209. The memory 203 communicates with processor 201 via control, address and data lines 210. The processor receives timing input signals from clock 204, which is a crystal and capacitor circuit. An alarm block 206 provides an audible signal to a user, to signal a tidal event for instance. For a more detailed representation of the hardware configuration of this embodiment, reference is made to FIG. 15.

Figure 15A:
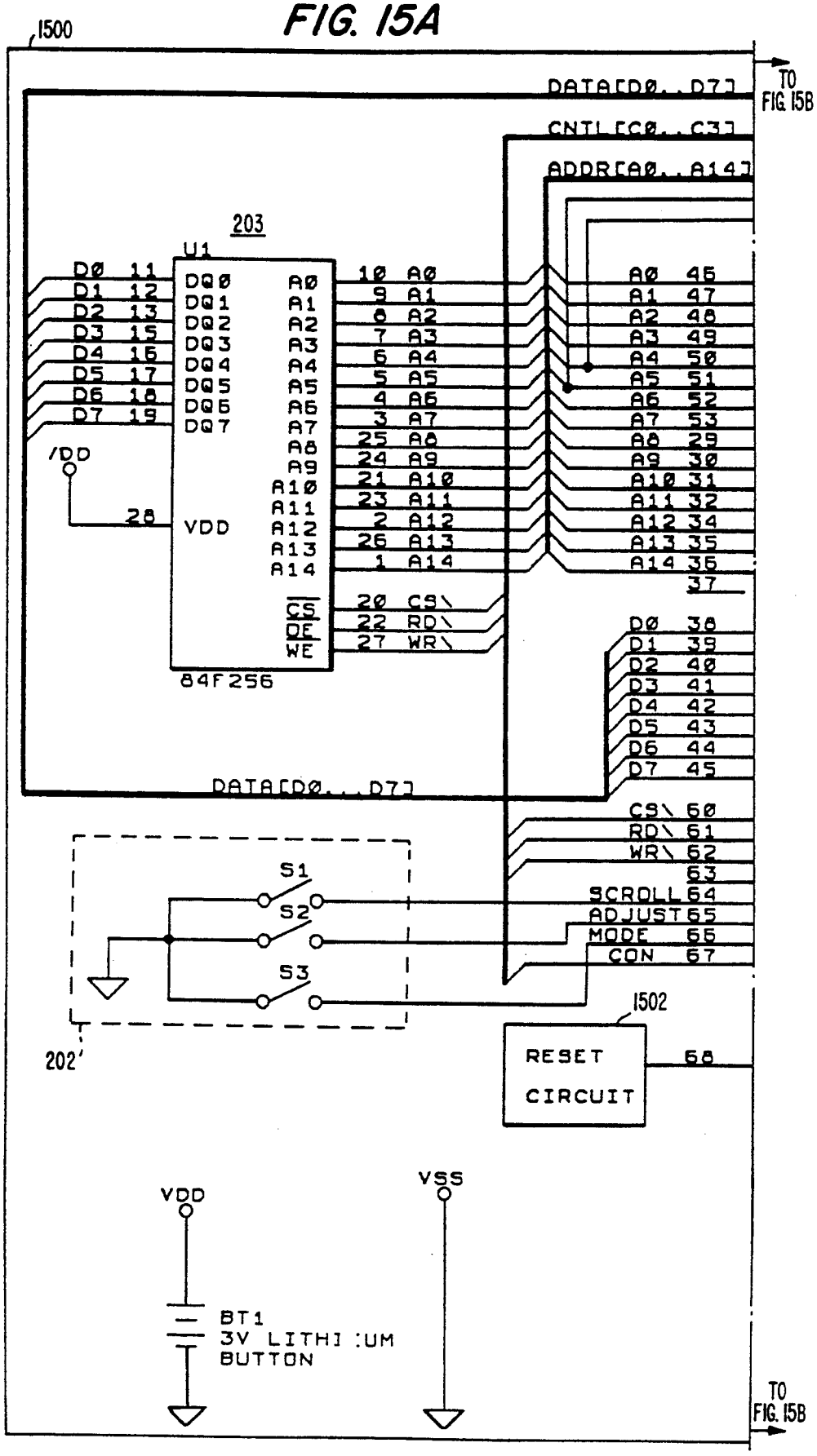
FIG. 15A, 15B, 15C are a simplified schematic diagram of an embodiment of the invention.
Figure 15B:
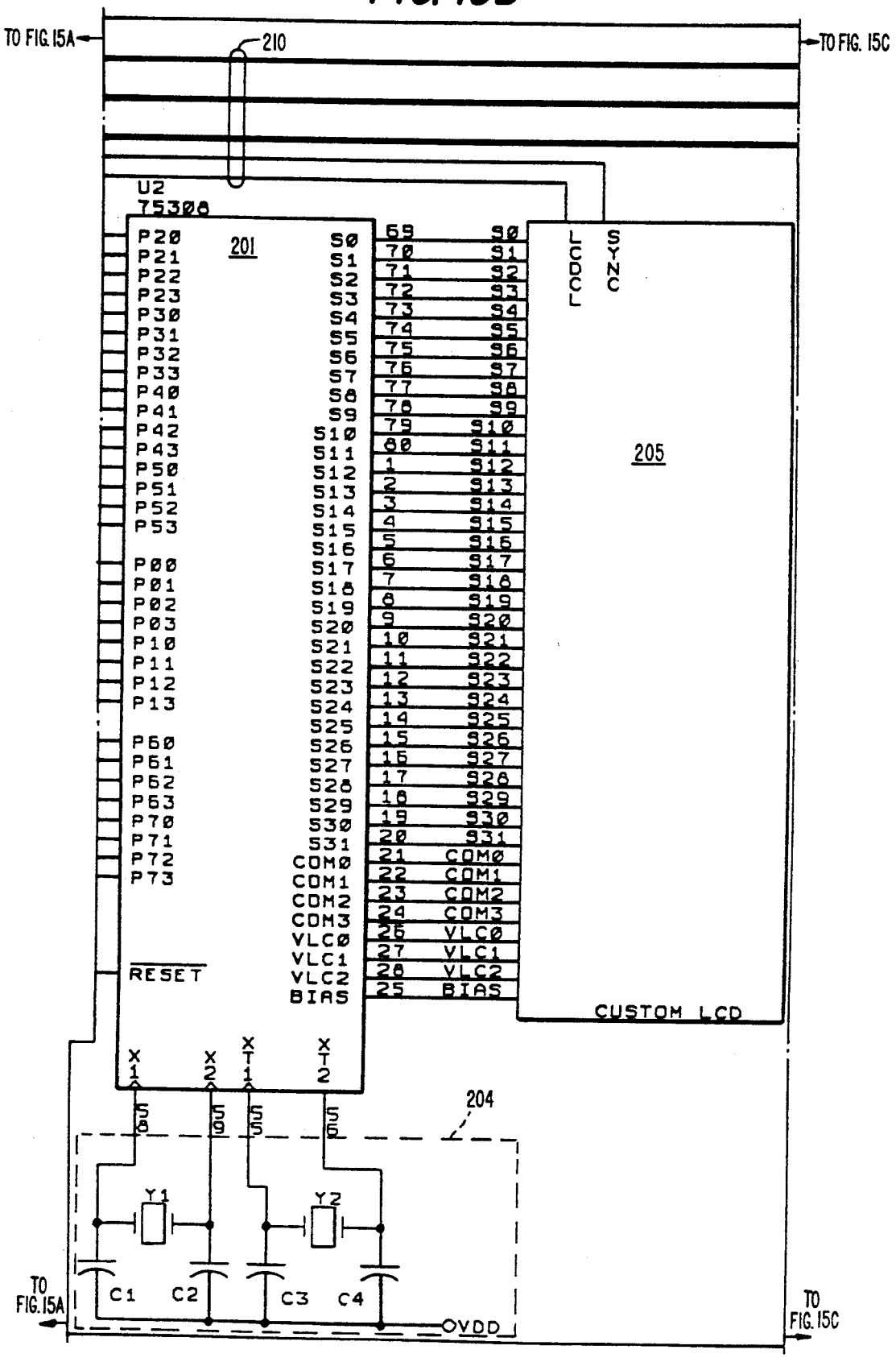
Figure 15C:
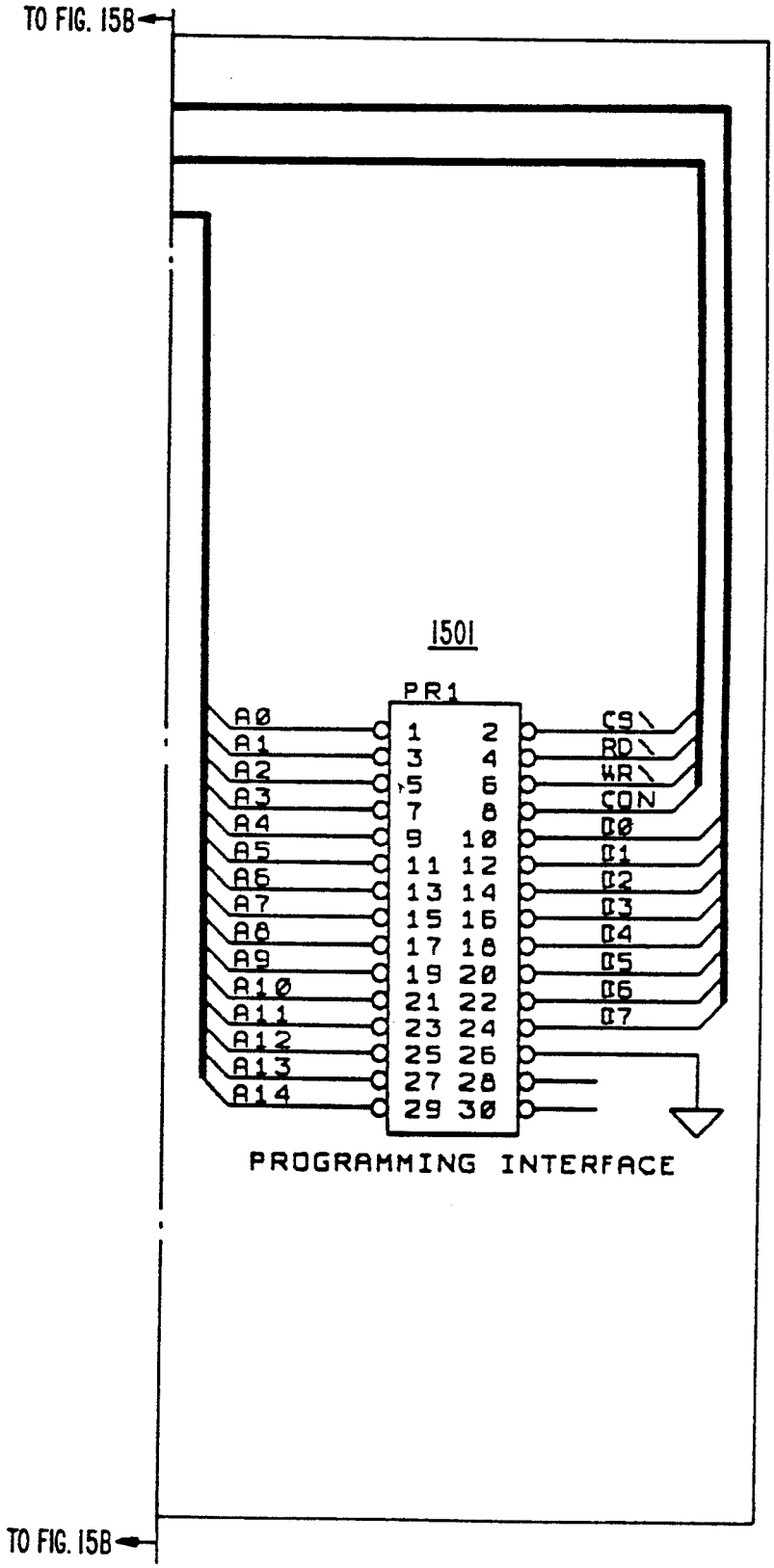

An embodiment of the claimed invention is shown in FIG. 15. The processor 201 is the heart of the system, and as shown is connected to custom Liquid Crystal Display (LCD) 205, memory 203, switches 202 (S1, S2, S3 and S4), programming interface 1501, reset circuitry 1502, and timing circuitry 204. This preferred embodiment is composed of two major integrated circuits (ICs), the memory 203 and the processor 201.

In a preferred embodiment, the processor 201 is an NEC 75308 4-bit microcontroller, which includes on-board an LCD driver 207, real-time clock, and 8k bytes of program memory 208 (Read Only Memory - ROM) or its equivalent. This microcontroller device, or one with similar features, is particularly suitable to the present invention embodied in a wrist watch, as it is small in size, is able to operate off a single battery of less than 3 volts, has on-board clock capabilities, an on-board LCD driver/controller, is able to access external data storage and process inputs, and contains on-board program memory, while being relatively inexpensive.

The memory 203 in a preferred embodiment is at least 32k bytes of static Random Access Memory (RAM), such as the Fijitsu MB-84F256-25, 32×8. This memory size is based on the space required to store all of the required tables for one year, with ten minute accuracy, and assuming local port offsets would be stored in permanent memory 208 (ROM). This type of memory (static) was required so that data would be retained at low power consumption levels. This RAM 208 communicates with the processor 201 via bus 210, which includes 15 address lines (A0–A14), 8 data lines (D0–D7), and control lines consisting of a chip select (CS), a read (RD) and a write (WR) line.

In another memory configuration, up to 3 years of data is stored in a 128K bytes of memory resulting in a maintenance cycle of three years.

In yet another memory configuration, memory for storing the tidal table data could be programmable read only memory (PROM) of the CMOS variety.

The programing interface (PI) 1501 is provided for programming the yearly tide data into static RAM 203. This PI 1501 is provided with the following lines and functions:

1) A connect line (CON) to inform the microcontroller of the presence of an external programming device;
2) Address lines (A0–A14).
3) Control signal lines:
   A) RD - read data signal, active when reading data,
   B) WR - write data signal, active when writing data, and
   C) CS - chip select signal, used to enable the RAM.
4) Data lines (D0–D7).
5) Signal ground.

Programming the yearly tide data into the RAM 203 through the interface 1501 is preferably done at a programming facility. The device will be taken apart, a new battery installed and the entire device connected to a programming and test fixture. Three of the data lines (D1–D3) may also serve as a serial communication link with the microcontroller 201 and may be used to thoroughly test all functions, such as a complete LCD test, a clock, alarm and ROM test, and a key switch test.

When the CON line goes low, the microcontroller 201 releases control of the RAM 203. At this time the programmer would load and verify new tidal information in the RAM 203. Then the device would be disconnected from the fixture, reassembled and tested for proper operation with the new data.

In an embodiment using PROM memory, the memory could be pre-programmed and then merely installed and tested when required.

The microcontroller's internal LCD driver 207 controls the custom LCD 205. All the necessary decoding and buffering takes place inside the microcontroller 201, and is maintained even in Halt mode. The LCD unit 205 is a custom device having all the necessary segments and annunciators.

A set of four switches 202 (S1–S4) operate to take the processor 201 out of the Halt mode (during which the processor is not executing code while maintaining both the realtime clock and the LCD, thereby conserving power). The processor 201 then checks to see which key 202 was pressed and starts executing code accordingly. The four keys 202 are the "scroll (105), adjust(101), mode(103) and memory (102)" keys. The functions they control will now be discussed with respect to the "user interface" and modes of operation.

USER INTERFACE

The following describes the user interface for one embodiment of the present invention. As described above, the present invention is a digital time keeping device which contains the following functional capabilities:

1) Predict the times of high and low tides for numerous ports and adjacent areas spanning the East West, and Gulf cost regions of the continental United States.
2) Allow the setting and display of the different Port-/Substations supported by the device.
3) Display the current time, date, and day of the week in standard or military format (24 Hour Clock).
4) Display the phases of the moon from New to Full and back to New with a resolution of 12 different phases.
5) Display the current water level height in 6 stages with a resolution of twelfths of maximum water height.
6) Generate an audible alarm for the arrival of a new hour, arrival of the next tidal event, or the arrival of a time as present by the user.

7) Function as a stop watch with a resolution of hundredths of a second.
8) Allow the user to establish Custom Ports by setting time offsets for high and low tidal events relative to any tidal port supported by the watch. The user may then display high and low tides on the upper display and on the water level indicator the water level, associated with the custom port. Offsets for the custom ports established by the user are kept in memory for future reference.

MODES OF OPERATION

The device user interface in one embodiment consists of the four keys (101, 102, 103 and 105) and the LCD display 124. The keys are labeled Mode, Adjust, Scroll, and Memory (see FIG. 1). The Mode key 103 allows the user to scroll through the auxiliary modes of operation provided by the device. The Adjust key 101 controls the entrance and exit for the different modes of operation. The Scroll key 105 in Mode 0 enables toggling of the different time and port values on the LCD 124 and is used to change the setting of displayed values in Modes 1–6. The Memory key 102 is used to enter and recall user selected ports which are stored in memory 203. The LCD 124 displays twelve different phases of the moon (118), six different states of current water height to twelfths resolution (109), the current mode of operation, current port, time of next tide, time of last tide, current time and date, and the alarm functions.

Briefly, the different functional modes available in the watch are as follows:

Mode 0 - Normal watch operation. The display 124 shows the current date, time, and day of week. The user can change the display 124 to show either the time and type of the next tide, time and type of the last tide, or the current port setting using the Scroll key 105. Activating the Memory key 102 will replace the current port with a port previously stored in watch memory and display the new port selected on the LC display 124. Repeated activation of the Memory key 102 will scroll through the other ports stored in memory 203.

Mode 1 - Set Port operation. The current port replaces the time of the next tide on the display 124 to allow the user to adjust the setting for the current port. Activation of the Memory key 102 anytime during the Set Port operation will store the port currently showing on the display 124 into watch memory 203.

Mode 2 - Tide Watch operation. The user can set the date on the watch and recall the first tide for that date. Activating the Scroll key 105 will sequentially display the times and type (High/Low) of the following tidal events for the current port. The Moon Phase display 118 and the date are updated to show the date and moon phase for the tidal events being displayed.

Mode 3 - Custom Port operation. Allows the user to enter personalized substation high and low tide offsets from any port supported by the device.

Mode 4 - Alarm clock operation. Allows the user to activate or deactivate the alarm clock function, hour chime function, and tide chime function. It also permits the user to enter the desired alarm time setting.

Mode 5 - Stop watch operation. Utilizes time of day display as a stop watch with hundredths of a second resolution.

Mode 6 - Set Time operation. The user can set the device to run in regular time keeping mode or select the military time option (24 hour). The user can also adjust the settings for the current time and date.

All modes of operation can be reached directly from Mode 0. Exiting any mode from 1 to 6 places the user back to Mode 0 (normal watch operation) with the upper display field showing the time of the "Next" tidal event. The available mode of operation is displayed on the LCD 124 as the user scrolls through the different modes using the Mode key 103. The modes are now described in more detail.

MODE 0: NORMAL WATCH FUNCTION

In Mode 0 (normal operation), the device displays the current time and date, and the time and type (High/-Low) of the next tide for the current port setting. The device also displays the current water height on the Water Level indicator 109. If the current "Next" tidal event is a high tide then the displayed water level will rise as the high tide approaches. Conversely if the "Next" tidal event tidal event is a low tide then the displayed water level will fall as the low tide approaches. The current moon phase for the displayed time and date is also displayed (118). The moon phase is always updated from right to left on the moon phase display 118. This allows the user to determine if the current moon is waxing or waning.

Activating the Scroll key 105 during normal operation scrolls the tide display from "Next" tide to "Last" tide, from "Last" tide to current "Port" setting, and finally from the current "Port" back to the "Next" tide. Activating the Memory key 102 at this time advances the current port setting to the next available port in memory ("Memory Port"), and changes the tide display to the "Port" setting, in order to display the new port.

MODE 1: SET PORT FUNCTION

The Set Port option is reached from Mode 0 by activating the Mode key 103 once. The LCD 124 then displays a blinking "Set Port" prompt (115). The user enters the Set Port option by depressing the Adjust key 101. The upper display field now shows the current port setting with the first digit blinking and the "Port" prompt (112) displayed. Activation of the Scroll key 105 increments the value of the blinking digit while activation of the Mode key 103 accepts the current value of the blinking digit and advances to the next digit. Activation of the Memory key 102 at any time during the sequence inserts the currently displayed port value into watch memory as a "Memory Port". If there is no more room in which to store another Memory Port, then the oldest port in memory is displayed in the upper display field, blinking on and off to notify the user that a former memory port must be deleted to make room for the current entry. Activating the Scroll key 105 at this time advances the Memory Port being displayed in the upper display to the next oldest Memory Port. Activation of the Mode key 103 deletes the port being displayed in the upper display field and inserts the current set port into memory 203 and the upper display field. The user is then returned to the original entry state with the first port digit blinking from where he can enter another port for entry into the memory or to establish a new current port. Activating the Adjust key 101 at any time makes the currently displayed port the current port and returns the user to the Mode 0 (normal watch) mode of operation.

MODE 2: TIDE WATCH FUNCTION

The Tide Watch option is reached from Mode 0 by activating the Mode key 103 twice. At this time the display shows a blinking "Tide Watch" prompt (111). Activation of the Adjust key 101 enters the Tide Watch mode of operation with the time of the next tide displayed blinking in the upper display field. At this time the user has at least two options. He can either scroll through succeeding tidal events by activating the Scroll key 105 or he can set a future date by activating the Mode key 103. If the Mode key 103 is selected then the Month field on the display will start blinking. Each activation of the Scroll key 105 increments the current blinking digit, and activating the Mode key 103 causes the current blinking value to be accepted and advances to the next digit. Once the date is set, the first tide of that date is displayed in the upper field. Activating the Scroll key 105 at this time displays the time of the successive tides for the current port setting. The date display and the moon phase are updated to reflect the actual date and moon phase for the tidal event being displayed. Activation of the Adjust key 101 exits the Tide Watch mode and returns the user to the Mode 0 (normal watch) mode of operation. The current time, date, moon phase relative water level, and time of the next tide with respect to the current time are displayed on the LCD 124.

MODE 3: CUSTOM PORT FUNCTION

The Custom Port option is reached from Mode 0 by activating the Mode key 103 three times. At this time the display shows a blinking "Set Time" (110) and "Set Port" (115) prompts. Activating the Adjust key 101 enters the Custom Port mode of operation with the plus or minus offset for the high tide displayed in the lower display field (the default is zero offset). The high indicator 114 and the plus or minus indicator 106 are blinking. The plus or minus indicator 106 can be toggled using the Scroll key 105. Selecting the Mode key 103 accepts the current displayed value and advances to the hour offset field. Editing the high tide offset is accomplished using the Scroll 105 and Mode 103 keys where the Scroll key 105 increments the current blinking digit and the Mode key 103 accepts the current displayed value. After the high tide offset is entered the upper display field indicates low tide and the lower display field shows the low tide offset and the above operation is completed. Activation of the Adjust key 101 stores the entered offsets into the memory as a Custom Port.

The port displayed in the upper display is changed with the substation field (last two digits, 123) assigned a number (for instance in one embodiment a number from 99 to 90 for ten Custom Ports) depending on the number of Custom Ports already assigned to the major port (first two digits, 122). In the example above, substation numbers from 90 to 99 would be reserved for identification of the ten Custom Ports. If the memory allocated for Custom Ports is already full then the oldest Custom Port is displayed blinking in the upper display field to notify the user that a former Custom Port must be removed. Selecting the Scroll key 105 at this time displays the next oldest Custom Port in memory while activating the Mode key 103 deletes the currently displayed Custom Port and inserts the current Custom Port in memory. Activation of the Adjust key 101 exits the Custom Port function, makes the entered Custom Port the current port, and returns the user to the Mode 0 (normal watch) mode of operation.

It should be noted that the water level indicator changes to reflect the offset for the custom port, which is now the current port.

MODE 4: SET ALARM FUNCTION

The Set Alarm option is reached from Mode 0 by activating the Mode key 103 four times. At this time the display shows a blinking "Alarm" prompt (108). Selecting the Adjust key 101 enters the Set Alarm mode of operation.

The first of three alarm icons (Time Alarm 129, Hour Chime 130, and Tide Change Alarm icon 131) is displayed blinking. The user can toggle the display of the Time Alarm icon 129 with the Scroll key 105. Depressing the Mode key 103 with the icon displayed enables the Time Alarm and puts the device into the set alarm time mode of operation. The user then enters the desired time of the alarm using the Scroll key 105 to increment the current blinking character first AM and PM and the Mode key 103 to accept the current displayed value and advance to the next digit. Once the Time Alarm operation is complete the Hour Chime icon 130 is displayed blinking. Again, the user can toggle the icon on and off using the Scroll key 105. Selecting the Mode key 103 with the icon displayed enables the alarm while activating the Mode key 103 with the icon not displayed disables it. Once the Mode key 103 is selected again, the Tide Change Alarm icon 131 is displayed blinking. The Scroll key 105 toggles the icon on and off while the Mode key 103 selection enables or disables the alarm depending on the current state of the icon.

The Tide Change Alarm icon 131 when set indicates that at each successive tide change an alarm will sound.

MODE 5: STOP WATCH FUNCTION

The Stop Watch option is reached from Mode 0 by activation of the Mode key 103 five times. At this time the display will show a blinking "STW" prompt (119). Selecting the Adjust key 101 enters the Stop Watch function. The lower display field is set to zero and used as the stop watch display with the capability of displaying elapsed time from 0 to 99 minutes, 59 seconds, 99 hundredths of a second. The Mode key 103 starts and stops the counting of the stop watch function. The Scroll key 105 resets the count value of the stop watch to zero. Selecting the Adjust key 101 returns the user to the Mode 0 (normal watch ) mode of operation.

MODE 6: SET TIME FUNCTION

The Set Time option is reached from Mode 0 by depressing the Mode key 103 six times. At this time, the display shows a blinking "Set Time" prompt (110). Activation of the Adjust key 101 enters the Set time mode of operation. At this time, the user has the option of selecting Standard or Military time format, which is indicated by the display of "12:00" (Standard) of "24:00" (Military). The Scroll key 105 toggles the choice while the Mode key 103 accepts the currently displayed choice. Once this is done, the seconds field on the display is set to zero and the month field is blinking to show that it is the current field available for editing by the user. The Scroll key 105 increments the current blinking digit while the Mode key 103 accepts the displayed value and advances to the next digit. Once the month, date, hour, and minute fields have been set, the lower display will present the user with the first year of tidal data currently stored in the device. The user can modify the year displayed as the current year using the Scroll key 105 and Mode key 103 editing procedure as was used in setting the time. Once the year is entered the "DST" icon (121) starts blinking for setting the DAYLIGHT SAVINGS TIME mode of operation. Selecting the Scroll key 105 turns "DST" 121 on and off. Selecting the Mode key 103 with "DST" displayed, sets the device operation to the DAYLIGHT SAVINGS TIME mode of operaion. The above process continues until the Adjust key 101 is activated at which time the currently displayed time and date become the current time and date. The user is then returned to the Mode 0 (normal watch) mode of operation.

The above description of the modes of operation is representative of one embodiment of the invention. It should be understood that various modifications ar considered within the scope of the invention. For instance, the number of Custom Ports may be larger or smaller than the ten used in the example.

DATAFLOW DIAGRAMS

The following description provides definitions for all dataflow, process, and file structures used by an embodiment of the device, and found on the dataflow diagrams (FIGS. 3 to 8), as well as definitions for the data elements which comprise the defined dataflows. This description is organized in a top down hierarchy which mirrors the dataflow diagrams, with all dataflow, process, and file definitions grouped together in alphabetical order for each level of decomposition. The definitions for dataflows, data elements, and files are found at the level in which they first appear. Occurrences of dataflows, data elements, or files at levels below their definition level are identified with a reference to the location which contains their definition. This description should be reviewed in conjunction with the dataflow diagrams (FIGS. 3 to 8).

TOP LEVEL OVERVIEW

The top level overview (FIG. 3) details the structure of the major data processing components of one embodiment of the invention. There are two sources of inputs to the Tide Watch process of the device which are located in the Watch Keys and System Clock Source blocks. The Watch Keys are composed of the four external switches (202) which are available to the user to access the different operating features of the device. The System Clock is a hardware supplied stimulus which drives the Tide Watch process and consists of an implementation defined discrete time base parameter, which should typically be on the order of a few milliseconds.

The Tide Watch process of the embodiment produces two outputs which are shown as the Alarm and LCD Display sink blocks. The Alarm block drives hardware circuitry capable of generating an audible tone. The LCD Display block, which drives the display 124, serves as an interface between the current state of the Tide Watch process and the user. Information displayed on the LCD may include the current time, tidal information (time of next or last tide, tide type of next or last tide, current port setting), moon phase, current water level, and the results of any key activation by the user in the different modes of operation.

Thus, the system is driven by the Tide Watch process which receives input from the Watch Keys and System Clock source blocks and generates the output for the Alarm and LCD Display sink blocks.

Figure 4A:
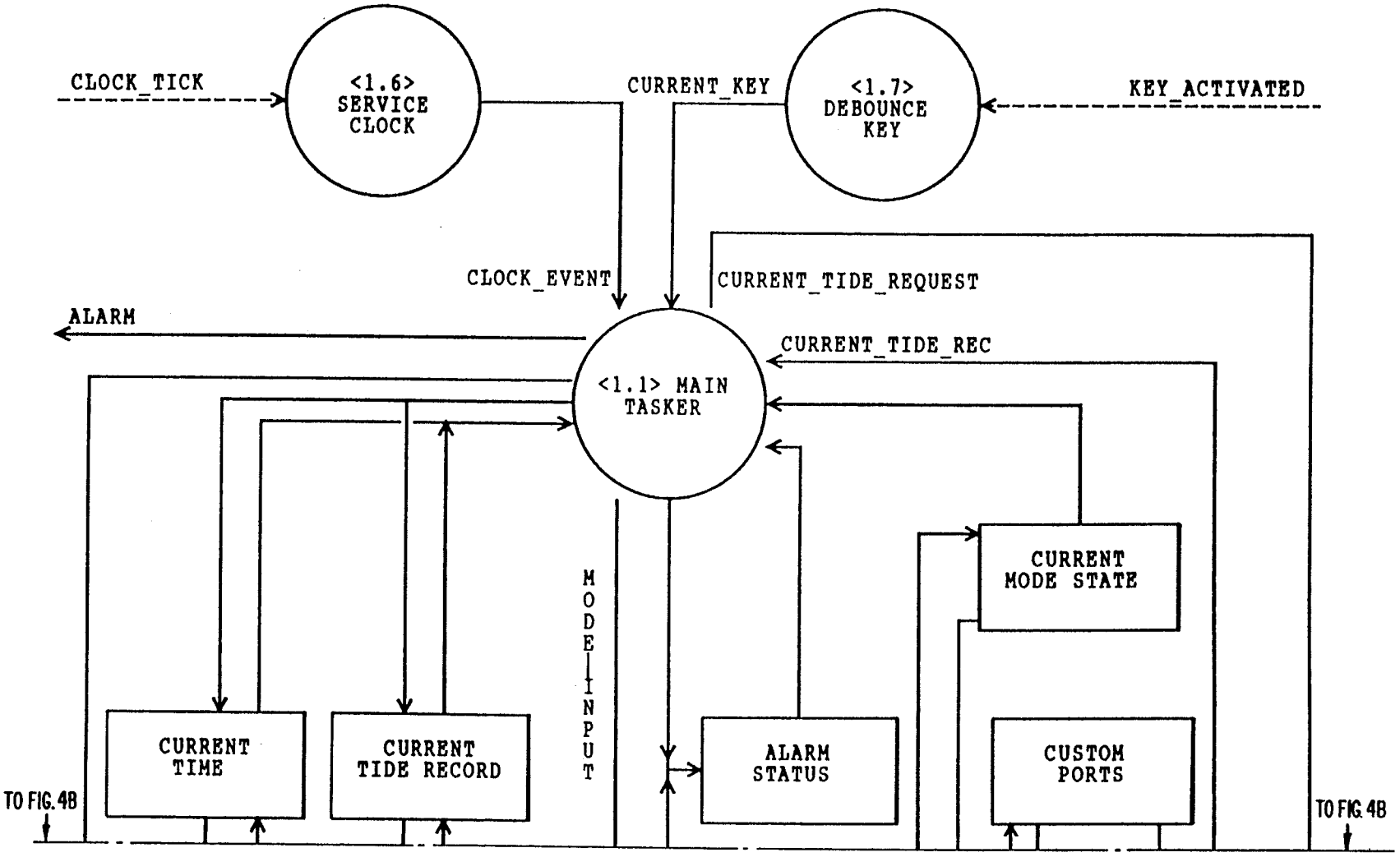
Figure 4B:
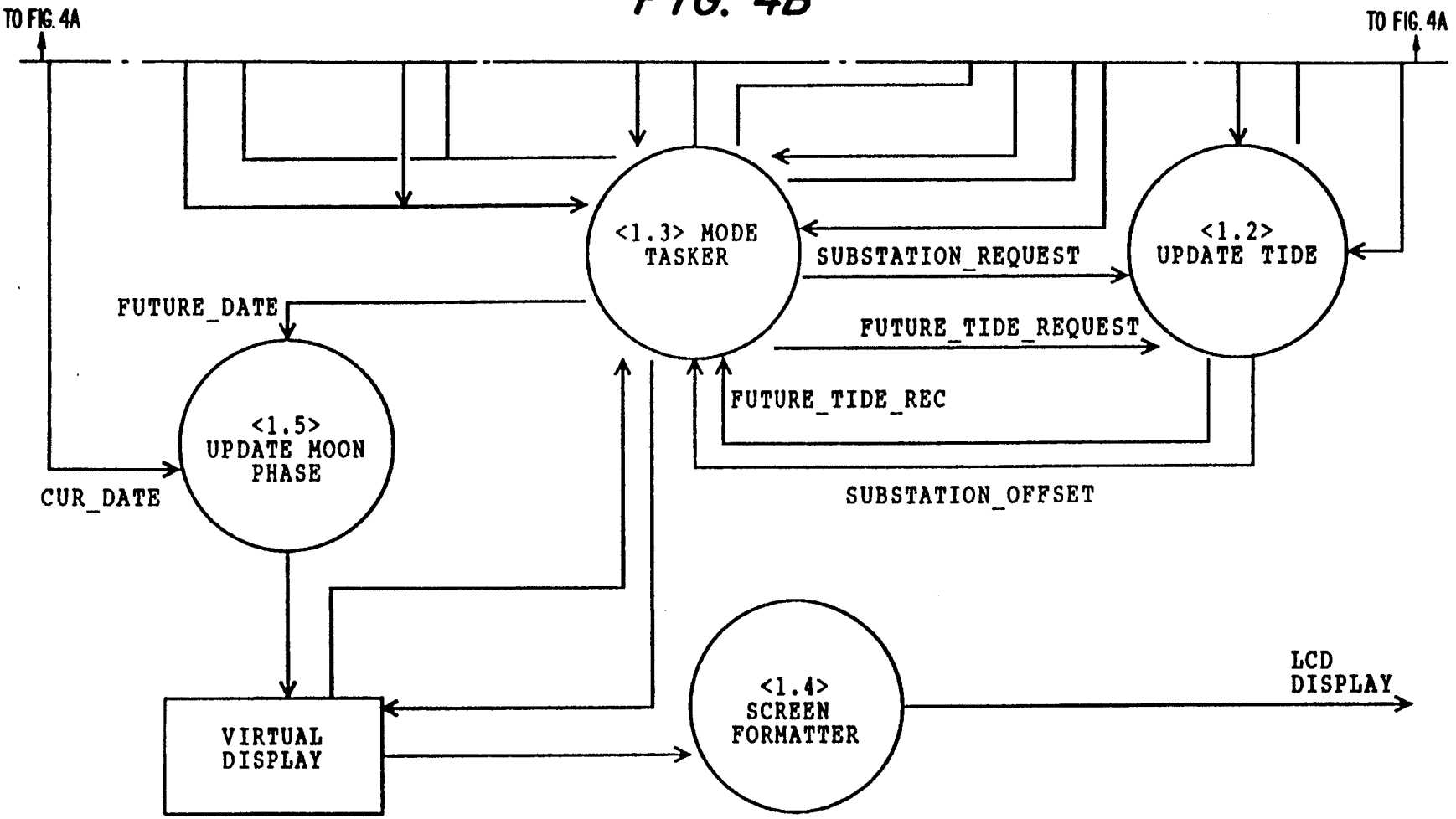

Referring now to FIG. 4, which is titled "1.0 TIDE WATCH PROCESS," the following description gives the dataflow name, followed by its definition and its composition.

Clock Event—Implementation defined Ticks. The arrival of Clock Event at the Main Tasker process drives the Tide Watch process and results in changes in the current state of the Tidal Watch.

Cur Date—Tens Time, Year. Cur Date holds the time stamp for the current time as known by the system. This information is utilized by the Update Moon Phase process to determine the current moon phase.

Current Key—No key, or Mode Key, or Scroll Key, or Adjust Key, or Memory Key. This dataflow input is generated by the activation of one of the four external keys available to the user.

Current Tide Request—Port, Substation, Rec Type, Time Type, Tens Time, Year. The Current Tide Request contains the information needed by the Update Tide process to retrieve the desired tidal information for the Tidal Database. The Current Tide Request time stamp contains the current time as known by the system and is utilized in determining the current tidal state for a given Port/Substation. Rec Type specifies a "Next" or "Last" tidal event. Time Type specifies Standard or Daylight Savings time.

Current Tide Rec—Tide Type, Tens Time. The Current Tide Rec contains the time of the requested tidal event (tens of minute since start of year) and the Tide Type (Hi or Lo).

Future Date—Tens Time, Year. Future Date holds the time stamp for a future tidal event. This information is utilized by the Update moon Phase process to determine the corresponding moon phase for the future tidal event as requested by the user.

Future Tide Request—Port, Substation, Rec Type, Time Type, Tens Time, Year. The Future Tide Request contains the information required by the Update Tide process to retrieve the desired tidal information from the Tidal Database. The Future Tide Request time stamp contains a future time and is utilized in displaying future tidal events to the user for a given Port/Substation. Time Type specifies either Standard or Daylight Savings time.

Future Tide Rec—Tide Type, Tens Time, Year. The Future Tide Rec contains the time and date of the requested tidal event (either Next tide or Last tide) and the Tide Type (Hi or Lo).

Mode Input—Current Key, or New Hundredth Sec. The Mode Input contains the user input Current Key which is used by the Mode Tasker process to direct the operation of the different functions available in the device. New Hundredth Sec marks the passage of one hundredth's of a second and is utilized in blinking edit fields and the Stop Watch mode of operation.

Substation Request—Port, Substation. Substation Request contains the information required by the Update Tide process to retrieve the substation high and low tide offset values from the database. This information is used in configuring user defined high and low tide offsets when entering Custom Ports.

Substation Offset—Hi Tide Offset, Lo Tide Offset. Substation Offset contains the high and low tide offsets for a given Port/Substation.

Next the data element definitions are given with respect to the data flow chart of FIG. 4. The data element is given, followed by its values and meaning, and any aliases.

Current Key—Integer value in the range of 0 to 4 which represents which of the four keys available to the user has been activated. These keys are defined a follows: 0—No Key: No key selected; 1—Mode Key:

Mode key selected; 2—Scroll Key: Scroll key selected; 3—Adjust Key: Adjust key selected; and 4—Memory Key: Memory key selected.

Clock Event—Clock Event is an implementation defined value which represents the passage of a discrete quantum number of hardware generated Clock Ticks. The maximum range of time represented by this value cannot exceed ten milliseconds as the Tidal Watch must have access to a minimum time granularity of ten milliseconds to display hundredths of a second while in the Stop Watch mode of operation.

Hi Tide Offset—Substation offset which holds the plus or minus time difference between a high tide event at the substation and the time of the same event at the port to which it is attached. This value is in units of (1-5 minutes depending on the size of the memory) and can hold a value from +10 to −10 hours.

Lo Tide Offset—Substation offset which holds the plus or minus time difference between a low tide event at the substation and the time of the same event at the port to which it is attached. This value is in units of (1-5 minutes depending on the size of the memory) and can hold a value from +10 to −10 hours.

Port—Integer in the range of 1 to the number of ports contained in the database which is used to differentiate among the different ports contained in the database.

The device database contains all the tidal ports monitored by the N.O.A.A. in the continental United States. At present this number is equal to 36 ports, however a few of these ports (inland ports located on rivers that empty into the ocean) can be dropped to make more room in the database if required by hardware considerations.

Rec Type —Binary value: 0—Last tide; 1—Next tide. This record identification tag is used to differentiate among the two different tidal records available for a given point in time. The Last tide is that tidal event that occurred previously to the time of interest. The Next tide is that tidal event that will proceed the time of interest.

Substation—Integer in the range of 0 to 99 which is used to differentiate the substations assigned to the Ports contained in the database. Substations tagged from 90 to 99 are designated as Custom Ports with the High and Low tide offsets entered by the user.

The actual number of substations assigned to any one port varies from port to port. Many ports will have fewer than 89 substations and therefore will have a smaller range of valid values.

Tens Time—Aliases: Current Tens Time, Next Tide Tens Time, Last Tide Tens Time. Unsigned integer in the range of 0 to 52704 which contains the date encoded as tens of minutes since Jan 1, 0:00 A.M.

The Tens Time data element only requires a resolution of tens of minutes as that is the granularity of the tidal records in the database and the moon phase tables. The upper range of Tens Time is determined by the maximum number of days (366 for leap year) * 24 hours * 6 tens of minutes per hour.

Tide Offset—Aliases: Hi Tide Offset, Lo Tide Offset. Signed integer in the range of 1 to 128 (1-600 for one minute offsets) which is a measure of the difference between the time of a tidal event at a substation and the port to which it is assigned in units of 1 or 5 minutes depending on whether 1 minute or 5 minute resolution is used.

The resolution of the Substation Offset Database is set at 5 (or 1) minutes to allow for storage of offsets as large as ten hours in a signed byte value composed of 8 (or 10) bits.

Tide Type—Binary value: 0—Low tide; 1—High tide. This identification tag is used to distinguish between High and Low tidal events returned from the database.

Time Type—0—STANDARD TIME, 1—DAYLIGHT SAVINGS TIME. Time Type is used to track the current time standard being used for the current time setting of the watch. This is utilized in making adjustments to tidal records which are stored in local STANDARD TIME.

Year—Integer value with range of 0 to 99. The Year data element is used to distinguish which section of the database to access for the desired tidal record and for determination of leap years.

The following gives the process definitions with respect to the data flow chart of FIG. 4. The process is listed followed by its description.

Main Tasker 1.1 (see also FIG. 5):

1. For each Current Key input:

1.1 Send Mode INput to Mode Tasker process.

1.2 Check Current Mode State file and generate Current Tide Request if port or current time has been changed.

2. For each Clock Event input:

2.1 Update system time.

2.2 Generate Current Tide Request if current system time is greater than current "Next" tide time.

2.3 Generate Alarm if alarm condition is detected and found enabled in Alarm Status file. If alarm is sounded then update the Alarm Status file.

Update Tide 1.2 (see also FIG. 6):

1. For each Future Tide Request input:

1.1 Retrieve tidal record corresponding to the Future Tide Request parameters from the database and return Future Tide Rec.

2. For each Current Tide Request 2.1 Retrieve tidal record corresponding to the current Tide Request parameters from the database and return the Current Tide REc.

Mode Tasker 1.3 (see also FIG. 7):

b 1. For each Mode Input input:

1.1 Perform required task according to current state and operational mode of the system using information contained in Custom Port, Current Time, and Current Tide Record files. Issue Future Tide Request and Future Date if operational mode=Tide Watch and new tidal event is requested. Update Virtual Display file.

Screen Formater 1.4:

1. For each activation of the process:

1.1 Fetch the screen information from the Virtual Display file and translate it for display on the LCD.

1.2 Perform the necessary hardware manipulation to display the information on the LCD.

Update Moon Phase 1.5 (see also FIG. 8):

1. For each Cur Date input:

1.1 Calculate the moon phase in units of twelfths of a Synodic period (29 days, 12 hours, 44 minutes) which corresponds with the Cur Date parameters.

1.2 Update the Virtual Display file with the calculated moon phase information.

2. For each Future Date input:

2.1 Calculate the moon phase in units of twelfths of a Synodic period which corresponds with the Future Date parameters.

2.2 Update the Virtual Display file with the calculated moon phase information.

Service Clock 1.6:

1. For each Clock Tick input:

1.1Perform required actions to service hardware circuitry responsible for generating the Clock Tick input.

1.2 Increment the Clock Tick counter. If the implementation defined number of Clock Ticks have ben generated since the last issue of Clock Event then rest Clock Tick counter and issue a new Clock Event.

Debounce Keys 1.7:

1. For each Key Activation input:

1.1 If this Key Activation key is first activation or this Key Activation key=last Key Activation key then increment counter else reset counter.

1.2 If key counter=implementation defined Key Debounced value then issue Current Key and reset key counter.

The following are the file definitions with respect to the data flowchart of FIG. 4. The file name is listed followed by its composition.

Alarm Status—Hour Chime Status (Enabled/Disabled), Tide Alarm Status (Enabled/Disabled), Time Alarm Status (Enabled/Disabled), Hour, Minute, Hour Chime State, Tide Alarm State, Time Alarm State. The Status records are Boolean fields which indicate if the respective alarm is enabled or disabled. The Time Of Day field is the time of day for generating the Time alarm as set by the user. The State fields are used to rack an alarm in progress condition.

Current Mode State—Current System State, Mode Status, Default Display. Current System State tracks the current operational state of the system. Possible values are defined as follows: 0—Normal Watch; 1—Set Port Prompt; 2—Enter Port Setting; 3—Remove Memory Port; 4—Set Time Prompt; 5—Select Time Format; 6—Enter New Time; 7—Tide Watch Prompt; 8—Enter Future Time; 9—Show Future Tide; 10—Custom Port Prompt; 11—Enter Custom Port Hi Offset; 12—Enter Custom Port Lo Offset; 13—Remove Custom Port; 14—Set Alarm Prompt; 15—Set Alarm; 16—Set Alarm Time; 17—Stop Watch Prompt; and 18—Run Stop Watch.

Mode Status indicates a change of the system state following a mode operation (i.e. new port or time setting) or a return to the Mode 0 mode of operation is defined as follows: 0—No change; 1—New port; 2—New time; and 3—Return to Normal Watch.

Default Display is used to track which of the three possible entities is being displayed in the upper display field. Default Display is defined as follows: 0—Next Tide; 1—Last Tide; 2—Current Port.

Current Tide Record—Port, Substation, Next Tide Type (Hi/Lo), Next Tide Tens Time, Last Tide Tens Time. The Current Tide Record file contains the tidal information for the current Port/Substation which is applicable to the current time as known by the system. The times of the Next and Last tidal event are found here as well as the tide type for the Next tide. The tide type for the Last tide is always the inverse of the tide type for the next tide.

Current Time—Hour, Minute, Second, Day, Month, Day of Week, Current Tens Time, Start Year, Current Year, Time Type, Clock Event Counter. The Current Time file contains the current time and day of the week as known to the system. The Tens Time field is used by the processes that maintain the Current Tide Record is defined as the number of tens of minutes since the start of the year The Start Year field contains the starting year of the tidal database. The Current Year field contains the Current Year as known by system. Time Type is a Boolean value which indicates whether the current time is Standard od Daylight Savings. Day of Week is defined as an integer from 0 to 6 with the following values 0—Sunday; 1—Monday; 2—Tuesday; 3—Wednesday; 4—Thursday; 5—Friday; and 6—Saturday.

Custom Ports—Port [10], Substation [10], Hi Tide Offset [10], Lo Tide Offset [10], Age [10], Next Port. In one embodiment, there are ten records in the Custom Ports file which will allow a total of ten Custom Ports to be established by the user for two different Port settings. All Custom Port substations are in the range of 90-99 to differentiate them from regular substations in this embodiment. Hi and Lo Tide Offsets are in the form Hours/Minutes with a maximum of 8 hours and 59 minutes. The Age record is used to mark the time of the individual entries relative to the other ports and is used when deleting a Custom Port record when a new record is added and the file is already full. The maximum value for any Age entry is 9 in this embodiment. Next Port is used as a pointer in entering the removing Custom Port entries.

Virtual Display—Setport Label (On/Off), Tidewatch Label (On/Off), Settime Label (On/Off), Lo Tide Offset (On/Off), Next Label (On/Off), Last Label (On/Off), Port Label (On/Off), Hi Label (On/Off), Lo Label (On/Off), Plus Label (On/Off), Minus Label (On/Off), Upper Pm Label (On/Off), Lower Pm Label (On/Off), Stopwatch Label (On/Off), Setalarm Label (On/Off), Daylight Savings Label (On/Off), Time Alarm Icon, Hour Chime Icon, Tide Change Alarm Icon 131, Moon Phase [6], Water Level [6], Day of Week [7], Upper Display Field [2], Month Field, Date Field, Lower Display Field [3], Current Edit Digit, Edit Entry Value [2], Blink State (On/Off), Blink Counter. All labels, icons, Moon Phase, Water Level, and the Day of Week records in the Virtual Display file are Boolean. The Upper Display Field holds the current display value for the "Next Tide", "Last Tide", and "Port" field. The Lower Display Field holds the current Hour/Minute/Second when displaying the current time or the Minutes/Seconds/Hundredths value when in Stop Watch mode of operation, or the Hi/Lo offset value when entering a Custom Port. The Current Edit Digit is used during editing operations involving user input to mark the current field being edited. The Edit Entry Value is used as an editing scratch pad during blinking operations. The Blink State field is a Boolean indicator used to track the current state of any blinking operations while Blink Counter is used to control the On/Off duration of the blink.

Figure 5A:
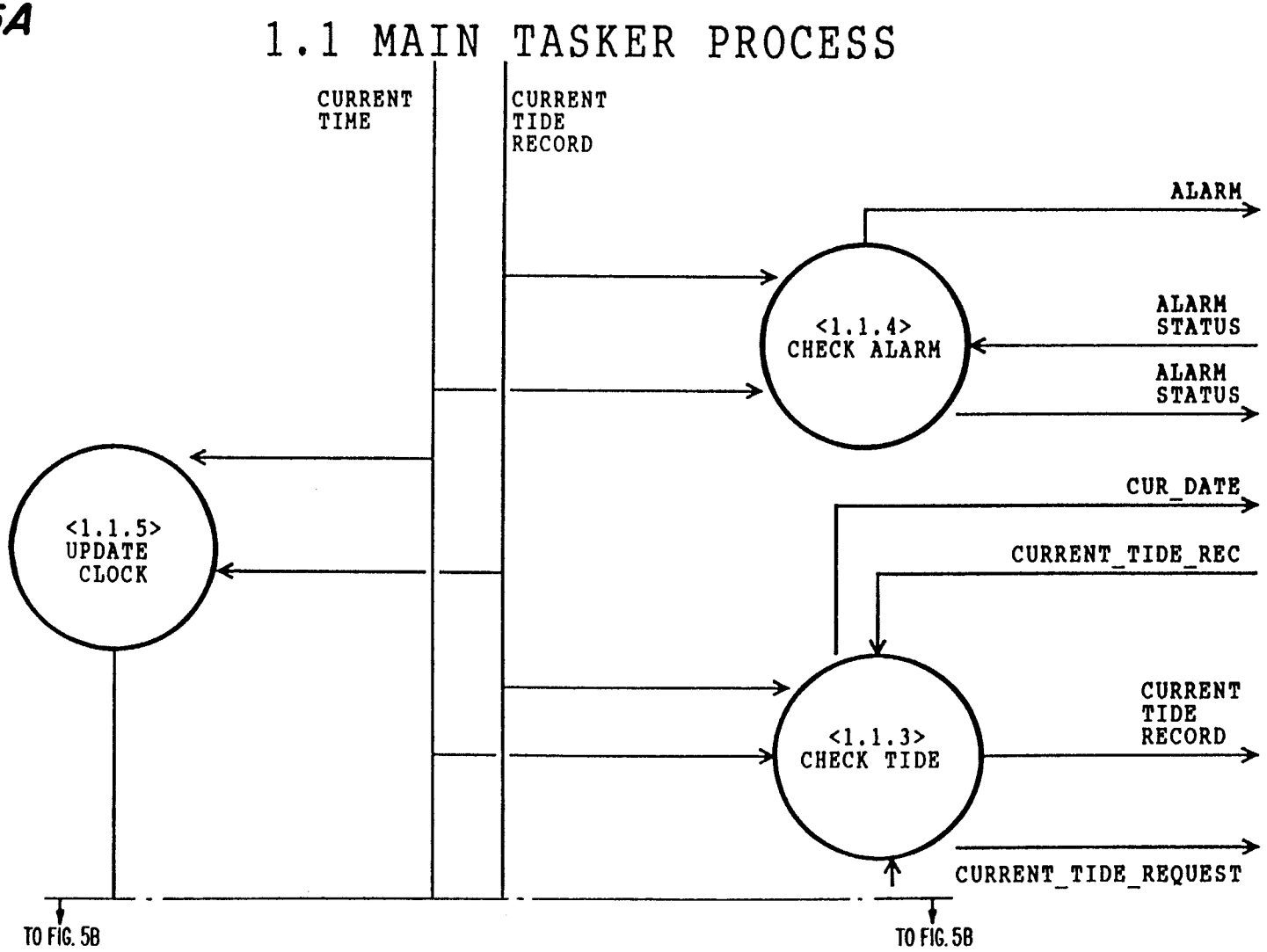
Figure 5B:
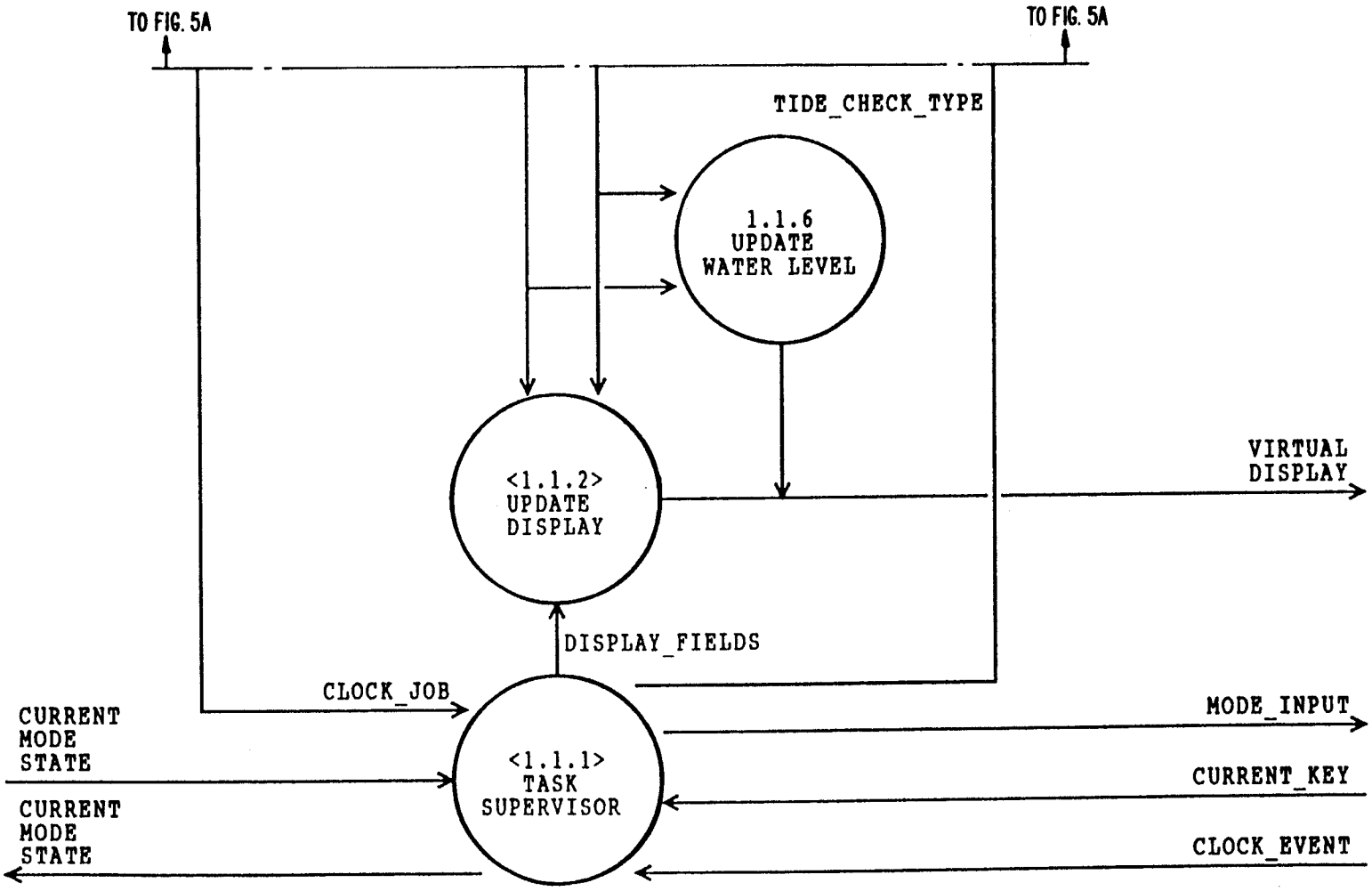

Referring now to FIG. 5, titled "MAIN TASKER PROCESS" described are the dataflow definitions. The dataflow is listed followed by its composition.

Clock Event—Reference 1.0 Tide Watch Process.

Clock Job—New Hundredth Sec, or New Second, or New Minute, or New Hour, or New Day. Clock Job allows for various levels of granularity in marking the passage of time. This dataflow is utilized by the Task Supervisor process as a trigger for updating the current state of different aspects of Tidal Watch operation such as the current time display, water level, moon phase, and tidal event.

Cur Date—Reference 1.0 Tide Watch Process.

Current Key—Reference 1.0 Tide Watch Process.

Current Tide Rec—Reference 1.0 Tide Watch Process.

Current Tide Request—Reference 1.0 Tide Watch Process.

Cur Date—Reference 1.0 Tide Watch Process.

Display Fields—Time Field, or Date Field, or Next Tide Field, or Last Tide Field, or Port Field, or Day of Week Field. Display Type Update allows the Update Display process to refresh specified fields of the LCD display. This is done to prevent conflict with screen fields that are currently under control of an operational mode of the Tidal Watch.

Mode Input Reference 1.0 Tide Watch Process.

Tide Check Type—Next Tide Check, or Tide Moon Check, or Moon Check. Tide Check Type directs the Check Tide process in generating Current Tide Requests and Cur Date.

The following description is of the data element definitions with respect to the data flowchart of FIG. 5. The data element is listed followed by its values and meaning.

Clock Job—Integer value that allows the Task Supervisor process to monitor the passage of time in different quantum. Clock Job is organized a an inclusive hierarchy where a high order job includes all lower level jobs. Possible values are as follows: 1—New Hundredth Sec: There have been one hundredth of a seconds worth of Clock Events since the last Clock Job was generated; 2—New Second: Second increment in Current Time file; 3—New Minute: Minute increment in Current Time file; 4—New Hour: Hour increment in Current Time file; and 5—New Day: Date increment in Current Time file.

Display Fields—Boolean bit field defined as follows: Bit 1—Time Field (On/Off); Bit 2—Date Field (On/Off); Bit 3—Next Tide Field (On/Off); Bit 4—Last Tide Field (On/Off); Bit 5—Port Field (On/Off); and Bit 6—Day of Week Field (On/Off). Display Fields allows the Update Display process to refresh those fields of the LCD display that are not under control of the current mode of operation of the Tidal Watch.

Tide Check Type—Integer value defined as follows: 0—Next Tide Check: Check the current "Next" tide record against the current time to see if it has expired; 1—Tide Moon Check: Check the current "Next" tide record against the current time to see if it has expired—Generate a Cur Date to update the moon phase; 2—Moon Check: Generate a Cur Date to update the current moon phase. Tide Check Type allows the Check Tide process to differentiate between the different tide and moon checks required by the current system state.

The following are process definitions with respect to the data flowchart of FIG. 5. Each process is listed followed by its description.

Task Supervisor 1.1.1:

1. For each Current Key input:

1.1 If Current Key does not equal No Key then Generate Mode Input.

1.2 Check Current Mode State file and if necessary initiate Check Tide, Update Water Level, and Update Display processes and update the Current Mode State file.

2. For each Clock Event input:

2.1 Initiate Update Clock process.

3. For each Clock Job input:

3.1 Generate Mode Input=New Clock Tick. Initiate Mode Switcher process.

3.2 If Clock Job=New Second then initiate Update Display process.

3.3 If Clock Job=New Minute, New Hour, or New Day then initiate Check Alarm, Update Water Level, Check Tide and Update Display processes.

Update Display 1.1.2:

1. For each Display Type Update input:

1.1 Update the display fields in the Virtual Display file indicated by the Display Type Update parameter using the information in the Current Time and Current Tide Rec files.

Check Tide 1.1.3:

1. For each Tide Check Type input:

1.1 If Tide Check Type=Next Tide Check or Tide Moon Check then 1.1.1 If Next Tide Tens Time in Current Tide Record file=Current Tens Time and the Current Time file and Minutes modulo 10 does not equal zero then generate Current Tide Request and store result in Current Tide Record file.

1.2 If Tide Check Type=Tide Moon Check or Moon Check then generate Cur Date.

Check Alarm 1.1.4:

1. For each activation of the process:

1.1 Check Hour Chime State, Tide Alarm State and Time Alarm State for Alarm In Progress state and if found then update state. If state=Alarms Finished then turn alarm off and update state to No Alarm In Progress. If alarm was Time Alarm then set Time Alarm Status to Disabled.

1.2 If Hour Chime Status, Tide Alarm Status, or Time Alarm Status=Enabled and corresponding state<>Alarm In Progress then check corresponding condition in Current Time file and Current Tide Record file and if alarm condition is present turn on corresponding alarm and update corresponding alarm and update corresponding alarm state field.

Update Clock 1.1.5:

1. For each activation of the process:

1.1 Increment Clock Event Counter in Current Time file.

1.2 Update the Current Time file 1.1.1 If Clock Event Counter=New Hundredth Sec then generate Clock Job=New Hundredth Sec.

1.1.2 If new Second<>old Second then generate Clock Job=New Second 1.1.3 If new Minute<>old Minute then generate Clock Job=New Minute 1.1.4 If new Hour<>old Hour then generate Clock Job=New Hour 1.1.5 If new Day<>old Day then generate Clock Job=New Day.

Update Water Level 1.1.6:

1. For each activation of the process:

1.1 Using Next Tide Tens Time and last Tide Tens Time for the Current Tide Record file and Current Tens Time from the Current Time file compute the current water level using the 1-2-3-3-2-1 rule of twelfths and update the Water Level field in the Virtual Display file.

The following are file definitions with respect to the data flowchart of FIG. 5. Each file is listed followed by its composition.

Alarm Status—Reference 1.0 Tide Watch process.

Current Mode State—Reference 1.0 Tide Watch process.

Current Tide Record—Reference 1.0 Tide Watch process.

Current Time—Reference 1.0 Tide Watch process.

Custom Ports—Reference 1.0 Tide Watch process.

Virtual Display—Reference 1.0 Tide Watch process.

Figure 6A:
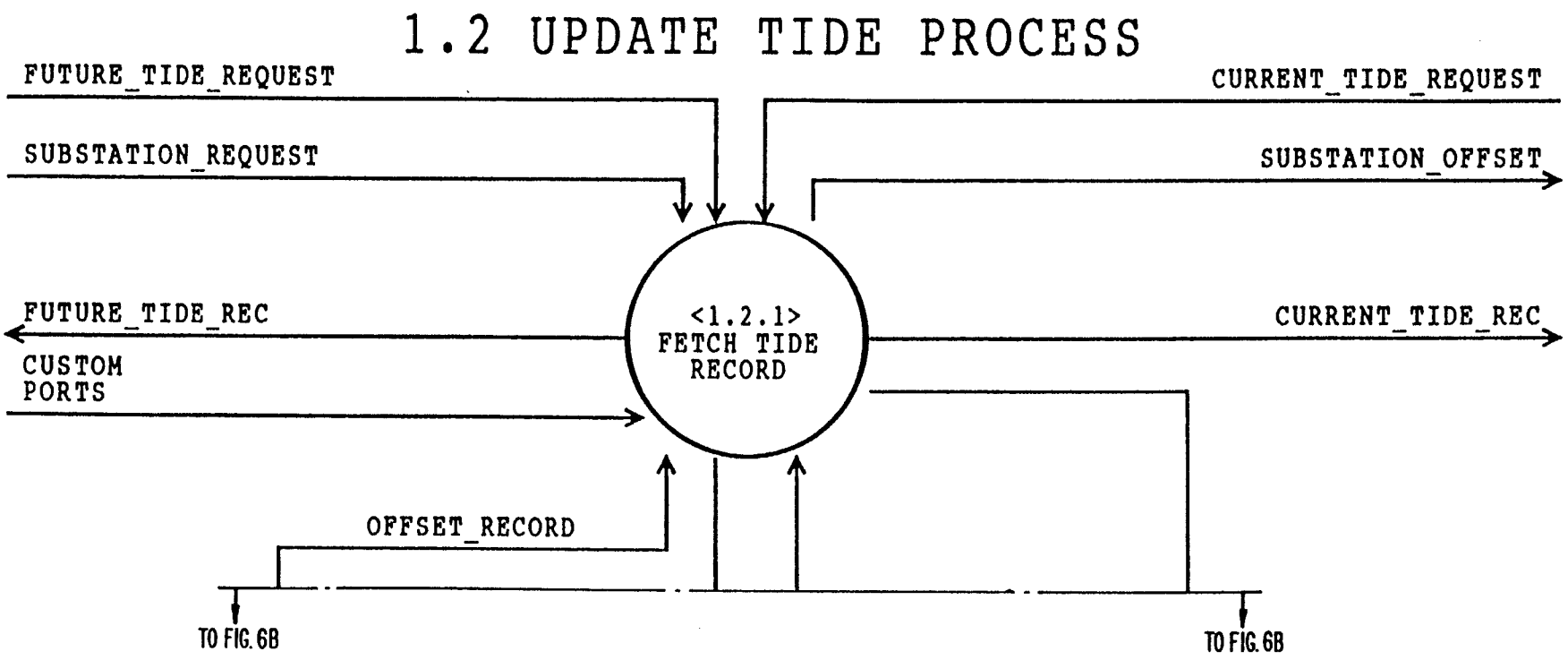
Figure 6B:
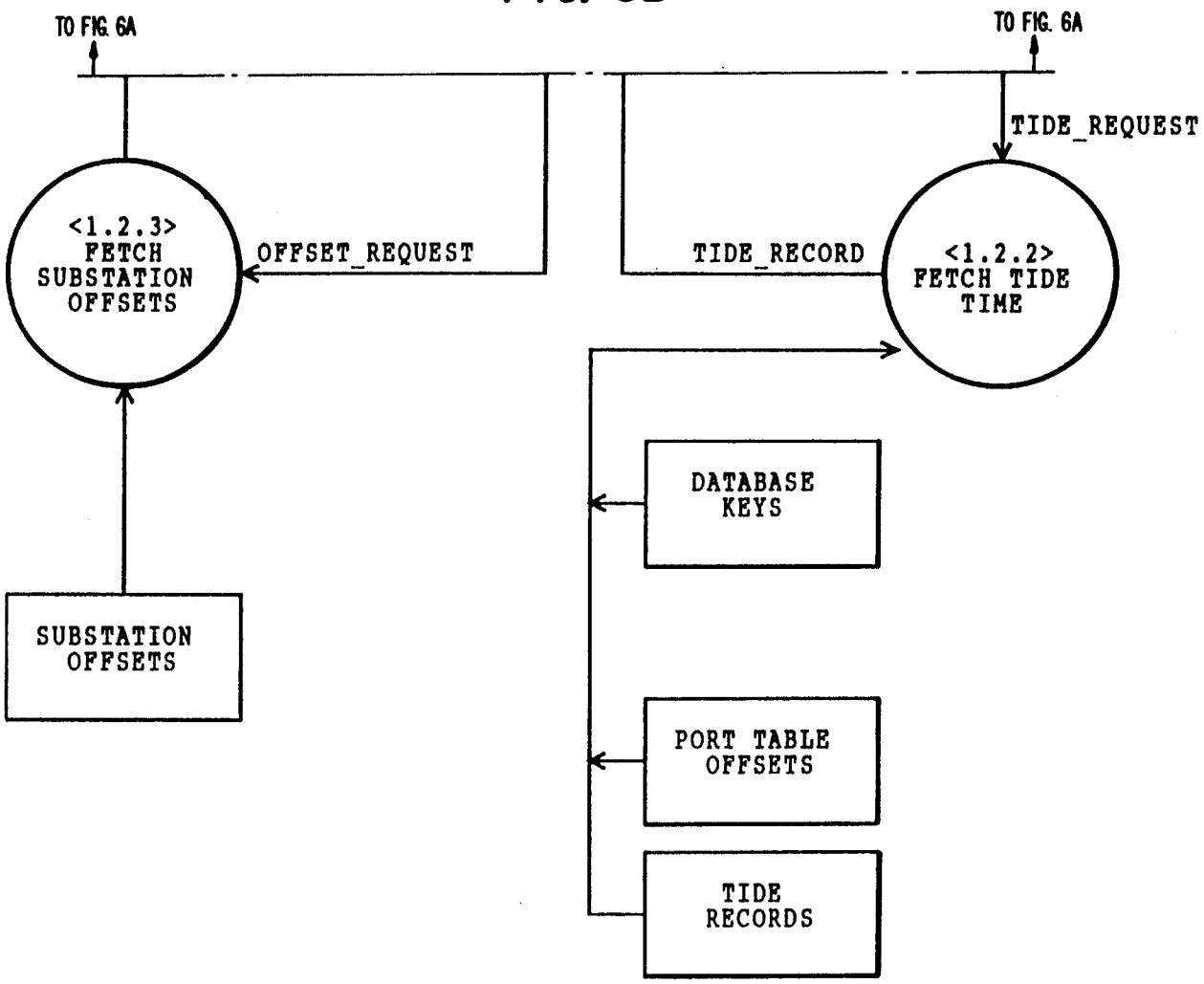

Referring now to FIG. 6, titled "Update Tide Process" the following are dataflow definitions. Each dataflow is listed followed by its composition and any aliases.

Current Tide Rec—Reference 1.0 Tide Watch process.

Current Tide Request—Reference 1.0 Tide Watch process.

Future Tide Request—Reference 1.0 Tide Watch process.

Future Tide Rec—Reference 1.0 Tide Watch process.

Offset Request—Port, Substation. Aliases: Substation Request. Offset Request is an alias of Substation Request generated inside the Update Tide process. It is used in building the Tide Request dataflow which is used in retrieving tidal event records from the Tide Records file.

Offset Record—Hi Tide Offset Lo Tide Offset. Aliases: Substation Offset. Offset Record is an alias of Substation Offset generated inside the Update Tide process. It is used in building the Tide Request dataflow which is used in retrieving tidal event records from the Tide Records file.

Substation Offset—Reference 1.0 Tide Watch process.

Substation Request—Reference 1.0 Tide Watch process.

Tide Record—Tens Time+Tide Type (Hi/Lo). Tide Record is generated in response to a Tide Request and contains the time and type of a tidal event for a specified port, substation and substation offset.

Tide Request—Port+Rec Type (Next/Last), Tens Time, Hi Tide Offset, Lo Tide Offset, Year. Tide Request contains the information needed by the Fetch Tide Time process to retrieve the desired tidal information from the Tidal Database. The Rec Type field indicates if the desired tide is the one immediately preceding the Tens Time field or the tide immediately following the Tens Time field. Tide Offset contains the High and Low offset that is to be used for this tide record fetch.

The following are data element definitions with respect to the dataflow chart of FIG. 6. Each data element is listed.

Hi Tide Offset—Reference 1.0 Tide Watch process.

Lo Tide Offset—Reference 1.0 Tide Watch process.

Port—Reference 1.0 Tide Watch process.

Rec Type—Reference 1.0 Tide Watch process.

Substation—Reference 1.0 Tide Watch process.

Tens Time—Reference 1.0 Tide Watch process.

Tens Time—Reference 1.0 Tide Watch process.

Tide Type—Reference 1.0 Tide Watch process.

Year—Reference 1.0 Tide Watch process.

The following are process definitions with respect to the dataflow chart of FIG. 6. Each process is listed followed by its description.

Fetch Tide Record 1.2.1:

1. For each Current Tide Request input:

1.1 If requested port=Custom port ten fetch Hi and Lo offsets from Custom Ports file.

1.2 Generate Offset Request 1.3 Generate Tide Request 1.4 Generate Current Tide Rec 2. Future Tide Request input 2.1 If requested ed port=Custom port then et Hi and Lo offsets from Custom Ports file, else 2.2 Generate Offset Request 2.3 Generate Tide Request 2.4 Generate Future Tide Rec 3. For each Substation Request input:

3.1 Generate Offset Request 3.2 Generate Substation Offset

Fetch Tide Time 1.2.2:

1. For each Tide Request input:

1.1 Fetch port offset for specified port from Port Table Offsets file.

1.2 Using the Database Keys file and the Tens Time from Tide Request fetch tide record from Tide Records file.

1.3 Using port offset from Port Table Offsets file, and the Hi/Lo Offsets and Rec Type from Tide Request verify tide record.

1.4 If tide record is valid then generate Tide Record else 1.5 Fetch next/last tide record and return to step 1.3.

Fetch Substation Offsets 1.2.3:

1. For each Offset Request 1.1 Fetch Hi and Lo Offsets for specified Port/Substation from Substation Offsets file.

1.2 Generate Offset Record

The following are file definitions with respect to the dataflow chart of FIG. 6. Each file is listed followed by its composition.

Custom Ports—Reference 1.0 Tide Watch process.

Database Keys—Total Ports, Record Size, Port Record Location [40], Port Record Size [40], Start Year, End Year, Tens Times Ptrs [55]. Total Ports is the number of ports supported by the tidal database, with a range of 1 to 40 in one embodiment. Record Size is the number of bytes in a tidal record which includes the Tens Time header and the Tens Time header offset for all the ports in the database (See Tidal Records file definition). Port Record Location contains the bit position in the tidal record for the start of the corresponding port (referenced by the array index). The Port Record Size contains the bit size of the port offset for the corresponding port (referenced by the array index). Start Year is then starting year of the database. End Year is the last year covered by the database. Tens Times Ptrs are addresses for the start of tidal records for each thousand increment of the Header Tens Times in the Tide Records file.

Port Table Offsets—Total Offsets [40]. Table Offsets contains the Tens Time table offset for each port in the tidal database. This offset is applied to each port record in the database.

Substation Offsets—Port Address [40], Number of Substations [40]. Port Address contains the starting addresses in the substation offset database for each group of substations assigned to the individual ports where the port is referenced by the array index. Number of Substations contains the number of substations assigned to each port where the port is referenced by the array index. The range of substations is defined as 0–89 in one embodiment.

Tide Records—Header Tens Time [Tides in one year], Tide Type [Tides in one year], Port Tens Time Offset [Ports in Database][Tides in one year]. Tide Records contains the tide times for the tide ports in the continental U.S. for an entire year. The Header Tens Time contains the time of all the tidal events for one year in Tens Time format. The Tide Type is a Boolean value that identifies the corresponding Header Tens Time as a High or Low tide. The Port Tens Time Offset contains the offset from the Header Tens Time that is used to determine the actual tidal event time for the individual ports. The records are grouped in a look-up table that is organized as follows:

| | | | | |
|---|---|---|---|---|
| Time of tide 1 - | Tide Type - | Port 1 Offset | ... | Port n Offset |
| Time of tide 2 - | Tide Type - | Port 1 Offset | ... | Port n Offset |
| ... | ... | ... | ... | ... |
| Time of tide n - | Tide Type - | Port 1 Offset | ... | Port n Offset |

Figure 7A:
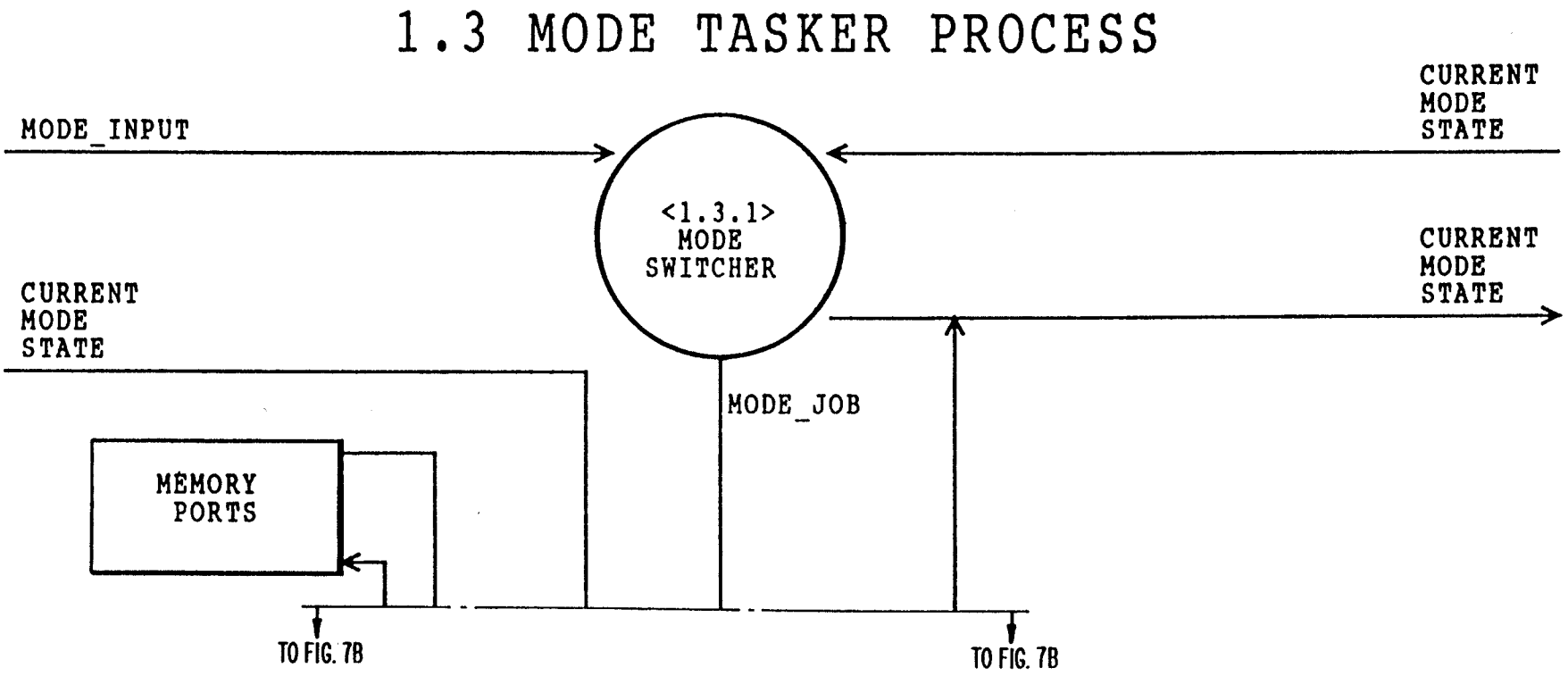
Figure 7B:
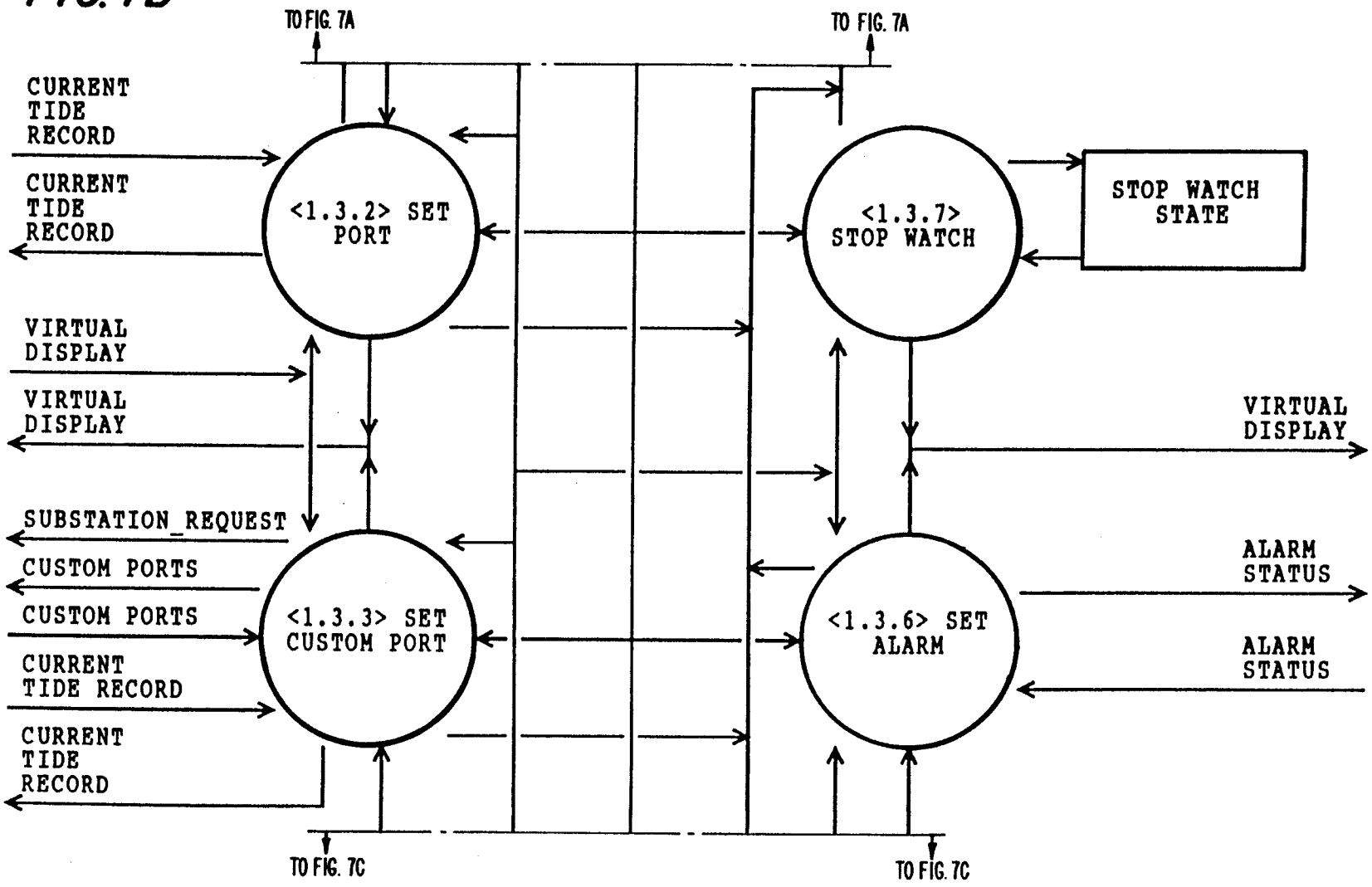
Figure 7C:
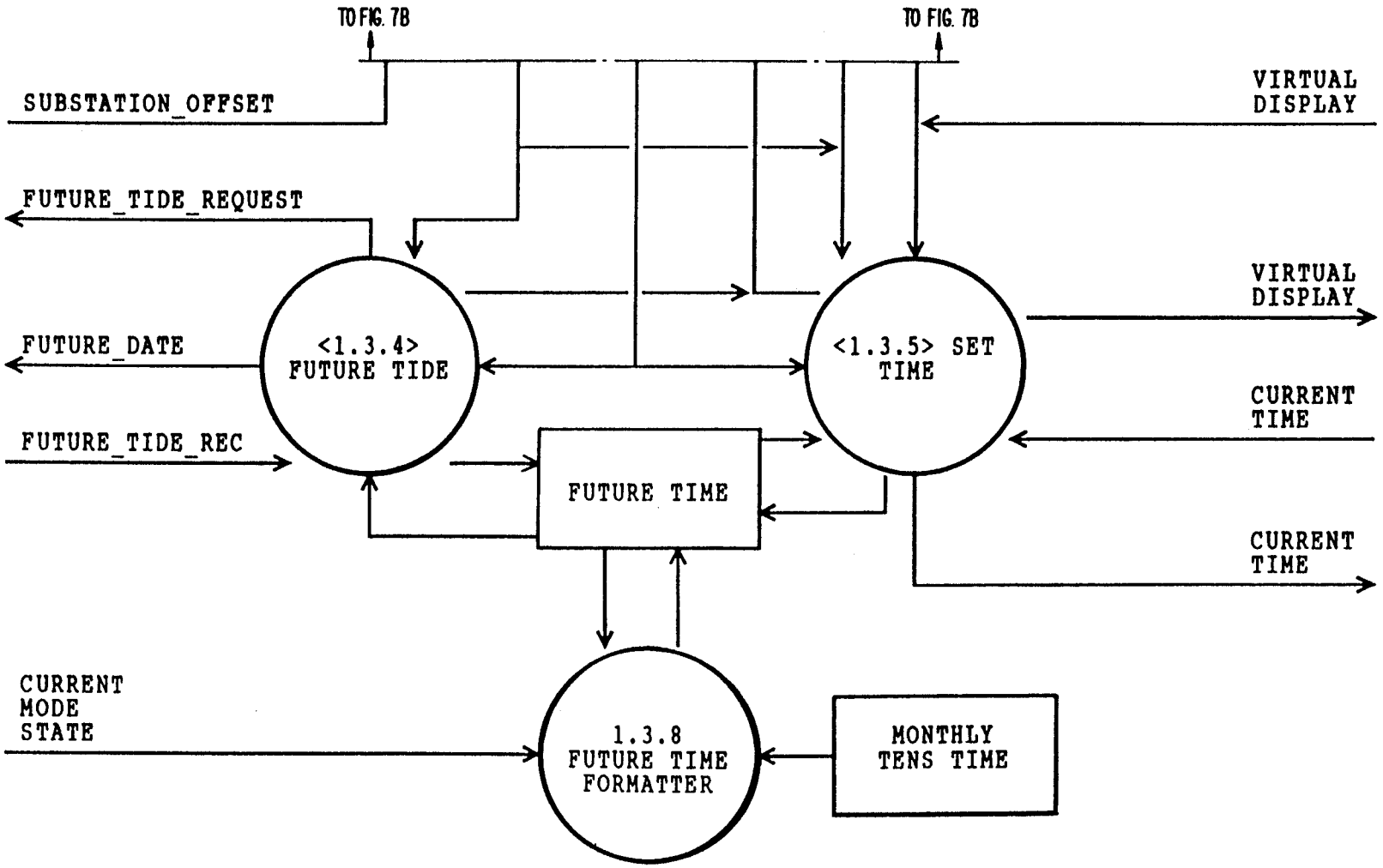

Referring now to FIG. 7, titled "Mode Tasker Process" the following are data flow definitions. Each dataflow is listed followed by its composition.

Future Date—Reference 1.0 Tide Watch process.

Future Tide Request—Reference 1.0 Tide Watch process.

Future Tide Rec—Reference 1.0 Tide Watch process.

Mode Input—Reference 1.0 Tide Watch process.

Mode Job—Scroll Key, or Mode Key, or Memory Key, or Mode Prompt, or Start Mode, or Exit Mode, or Hundredths Sec Tick. Mode Job is used to pass key input by the user to the different mode handling processes. Start Mode and Exit Mode are used to set up and exit the different mode of operations. The Hundredths Sec Tick is utilized by the Stop Watch process to track time while in the stop watch mode of operation. Hundredth Sec Tick is used to run the Stop Watch and is used in flashing edit field characters during user input.

Substation Offset—Reference 1.0 Tide Watch process.

Substation Request—Reference 1.0 Tide Watch process.

The following are data element definitions with respect to the dataflow chart of FIG. 7. Each data element is listed followed by its values and meaning.

Mode Job—Integer value defined as follows:

| | |
|---|---|
| 0 - Mode Prompt: | Display mode label on screen. |
| 1 - Mode Key: | Mode key selected. |
| 2 - Scroll Key: | Scroll key selected. |
| 3 - Start Mode: | Enter mode of operation. |
| 4 - Memory Key: | Memory key selected. |
| 5 - Exit Mode: | Exit mode of operation. |
| 6 - Hundredths Sec Tick: | Hundredth of a second has elapsed since last Hundredths Sec Tick. |

The following are process definitions with respect to the dataflow chart of FIG. 7. Each process is listed followed by its description.

Mode Switcher 1.3.1:

1. For each Mode Input input:

1.1 Decode Mode Input using the current contents of the Current Mode State file and generate Mode Job to the appropriate process.

Set Port 1.3.2:

1. For each Mode Job input:

1.1 If Mode Job=Mode Prompt then write Set Port prompt to the Virtual Display file and set Current System Sate in the Current Mode State file to Set Port Prompt else 1.2 If Mode Job=Start Mode then initialize the Virtual Display edit fields and set Current System State in the Current Mode State file to Enter Port Setting else 1.3 If Mode Job is Scroll or Mode key or=Hundredths Sec Tick then update the Virtual Display file and the Current Mode State file if necessary else 1.4 If Mode Job is Memory Key then 1.4.1 If Current System State in Current Mode State file=Normal Watch then insert Next Port port from Memory Port file into Current Tide Record, increment Next Port, and set Mode Status in Current Mode State file to New Port.

else 1.4.2 If Memory Ports file is not full then insert port in Virtual Display file into Memory Ports file.

1.4.3 Insert oldest port from Memory Ports file into Virtual Display file and set Current System State in Current Mode State file to Remove Memory Port.

1.5 If Mode Job=Exit Mode then insert port setting from Virtual Display file into Current Tide Record and set Mode Status in Current Mode State file in New Port.

Set Custom Port 1.3.3:

1. For each Mode Job input:

1.1 If Mode Job=Mode Prompt then write the Custom Port prompt to the Virtual Display file and set Current System State in the Current Mode State file to Custom Port Prompt.

else 1.2 If Mode Job=Start Mode then initialize the Virtual Display file edit fields using the Current Tide Rec file or the Custom Ports file. Generate Substation Request if current port is not already a Custom Port. Set Current System State in Current Mode State file Enter Custom Port Hi Offset.

else 1.3 If Mode Job is a user input key or=Hundredths Sec Tick then update the Virtual Display file and the Current Mode State file if necessary.

1.3.1 If end of Hi Offset edit then set Current System State to Enter Custom Port Lo Offset.

else 1.3.2 If end of Lo Offset edit then set Current System State to Enter Custom Port Hi Offset.

else 1.4 If Mode Job=Exit Mode then

1.4.1 If Custom Ports file is not full then insert custom port in Virtual Display file into Current tide Record file. Insert custom port and offsets into Custom Ports file. Set the Mode Status in the Current Mode State file to Return to Normal Watch.

else 1.4.2 Insert oldest port from Custom Ports file into Virtual Display file and set Current System State in Current Mode State file to Remove Custom port.

Show Future Tide 1.3.4:

1. For each Mode Job input:

1.1 If Mode Job=Mode Prompt then write the Tide Watch prompt to the Virtual Display file and set Current System State in the Current Mode State file to Tide Watch Prompt.

else 1.2 If Mode Job=Start Mode then insert "Next" tide time in Virtual Display file.

1.3 If Mode Job—Scroll Key then 1.3.1 If Current System State is Tide Watch Prompt then 1.3.1.1 Set Current System state to Show Future Tide.

1.3.2 If Current System State is Show Future Tide then generate Future Tide Request using Current Tide Record and Future Time file. Generate Future Date.

else 1.3.3 If Current System State is Enter Future time then update edit fields in Virtual Display file.

else 1.4 If Mode Job=Mode Key then 1.4.1 If Current System State=Tide Watch Prompt then set Current System Sate to Enter Future Time and initialize the edit fields in the Virtual Display file.

else 1.4.2 If Current System State=Enter Future Time then update edit fields in Virtual Display file.

else 1.5 If Mode Job=Hundredths Sec Tick then 1.5.1 If Current System State is Enter Future Time then update edit fields in Virtual Display file.

else 1.6 If Mode Job=Exit Mode then set Mode Status record in the Current Mode State file to Return to Normal Watch.

Set Time 1.3.5:

1. For each Mode Job input:

1.1 If Mode Job=Mode Prompt then write the Set Time prompt to the Virtual Display file and set Current System State in the Current Mode State file to Set Time Prompt.

else 1.2 If Mode Job=Start Mode then initialize the Virtual Display file edit fields using the Current Time file. Set Current System State in Current Mode file to Enter New Time.

else 1.3 If Mode Job is a user input key or=Hundredths Sec Tick then update the Virtual Display file.

1.4 If Mode Job=Exit Mode then inset time setting from Virtual Display file time fields into the Current Time file an set Mode Status in the Current Mode State file to New Time.

Set Alarm 1.3.6:

1. For each Mode Job input:

1.1 If Mode Job=Mode Prompt then write the Set Alarm prompt to the Virtual Display file and set Current System State in the Current Mode State file to Set Alarm Prompt.

else 1.2 If Mode Job=Start Mode then set Current System State in Current Mode State file to Set Alarm.

else 1.3 If Mode Job is a user input key or=Hundredths Sec Tick then update the Virtual Display file. If starting an alarm time entry then set Current System State in Current State Mode file to Set Alarm time. Update the Virtual Display file with time from the Alarm Status file.

else 1.4 If Mode Job=Exit Mode then inset time setting from Virtual Display file edit fields in the Alarm Status file and update the enable fields for all three alarms in the Alarm Status file. Set Mode Status record in the Current Mode State file to Return to Normal Watch.

Stop Watch 1.3.7:

1. For each Mode Job input:

1.1 If Mode Job=Mode Prompt then write the Stop Watch prompt to the Virtual Display file and set Current System State in the Current Mode State file to Stop Watch Prompt.

else 1.2 If Mode Job=Start Mode then set initialize the Virtual Display and Stop Watch State files and set Current System State in the Current Mode State file to Run Stop Watch.

else 1.3 If Mode Job is a user input key then update the Virtual Display and Stop watch State file.

else 1.4 If Mode Job=Hundredths Sec Tick then update the Virtual Display file and the Stop Watch State file.

else 1.5 If Mode Job=Exit Mode then set the Mode Status record in the Current Mode State file to Return to Normal Watch.

Future Time Formater 1.3.8:

1. For each activation of the process:

1.1 If Current System State of Current Mode State file=Enter Future Time then 1.1.1 Convert Month and Day from Future Time file using the information in the Monthly Tens Time file, to Tens Time format and store in Tens Time of Future Time file.

else 1.2.2 Convert Tens Time from Future Time file to month and date format and store in Month and Day of Future Time file.

The following are file definitions with respect to the dataflow chart of FIG. 7. Each file is listed followed by its composition.

Alarm Status—Reference 1.0 Tide Watch process.

Current Mode State—Reference 1.0 Tide Watch process.

Current Tide Record—Reference 1.0 Tide Watch process.

Current Time—Reference 1.0 Tide Watch process.

Custom Ports—Reference 1.0 Tide Watch process.

Future Time—Hour, Minute, Day, Month, Time Type, Day Of Week, Future Tens Time, Future Year. The Future Time file contains the future time and day of the week used for displaying future tidal events.

Memory Ports—Ports [5], Substations [5], Age [5], Next Port. There are five records in the Memory Ports file which will allow a total of five Memory Ports to be entered by the user and stored for future recall via the Memory Key. The Age record is used to mark the time of the individual entries relative to the other ports and is used when deleting a Memory Port record when a new record is added and the file is already full. The maximum value for an Age entry is 4. Next Port points to the next memory port to be selected if the user activates the Memory key in Normal Watch mode of operation.

Monthly Tens Time—Month Tens Time[12], Leap Year Tens Time [12]. The Monthly Tens Time file is used for conversions from tens time format to month and date format and from month and date format to tens time format. This file is utilized by the Future Time Formater process which is called during display of future tidal events in the Tide Watch mode of operation. The Month Tens Time array contains the tens time of the starting day for the 12 months of the year. The Leap Year Tens Time array contains the tens time of the starting day for the 12 months during a leap year.

Stop Watch State—Watch State (On/Off). Watch State is used to indicate if the stop watch is running or stopped.

Virtual Display—Reference 1.0 Tide Watch process.

The Screen Formater Process 1.4 consists of the implementation defined LCD display driver. This process will use the information in the Virtual Display file and translate it for display on the LCD.

Figure 8:
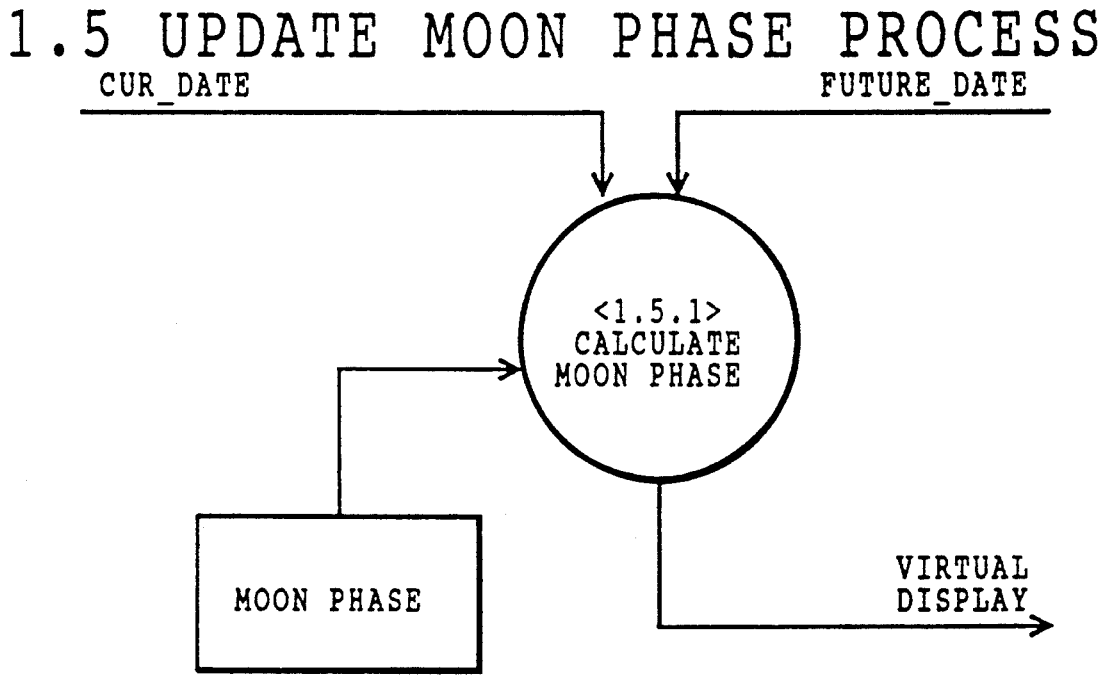

Referring to FIG. 8, titled "Update Moon Phase Process" the following are dataflow definitions associated with the process.

Cur Date—Reference 1.0 Tide Watch process.

Future Date—Reference 1.0 Tide Watch process.

The following are process definitions with respect to the dataflow chart of FIG. 8. Each process is listed followed by its description.

Calculate Moon Phase 1.5.1:

1. For each Cur Date and Future Date input:

1.1 Fetch the moon phase record from Phase file that corresponds to the Tens Time filed in Cur Date or Future Date and calculate the current moon phase.

1.2 Store moon phase information in Moon Phase record in Virtual Display file.

The following is the file definition with respect to the dataflow chart of FIG. 8.

Moon Phase—Tens Offset [2], Tens Cycle Time. The Moon Phase file contains the information needed to calculate a moon phase from a given Tens Time. The Tens Offset array contains the amount of tens time for the start of a year before the beginning of a new moon phase cycle (new moon). The Tens Cycle Time contains the tens time of a Synodic period (full moon cycle)

Figure 9A:
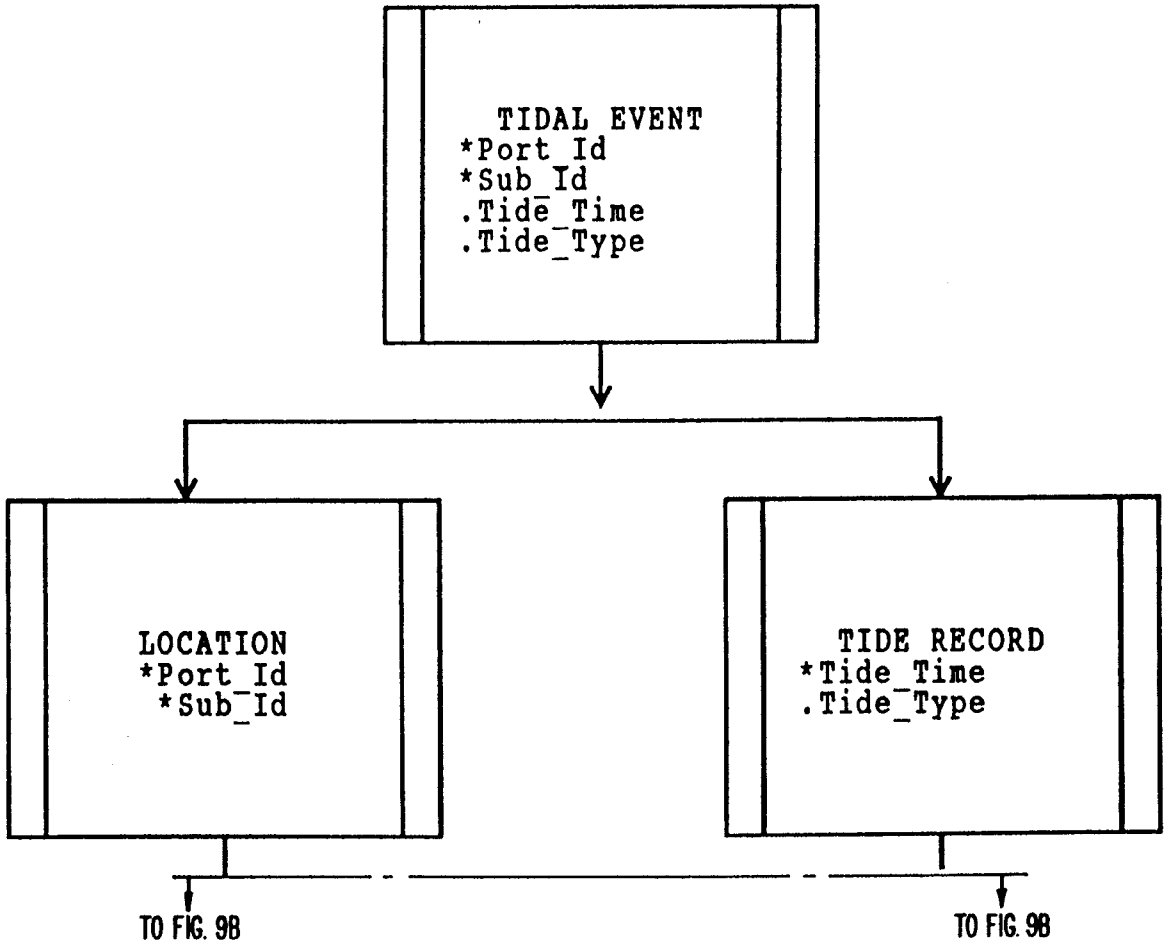
FIGS. 9A, 9B are an entity-relationship diagram of an embodiment of the invention.
Figure 9B:
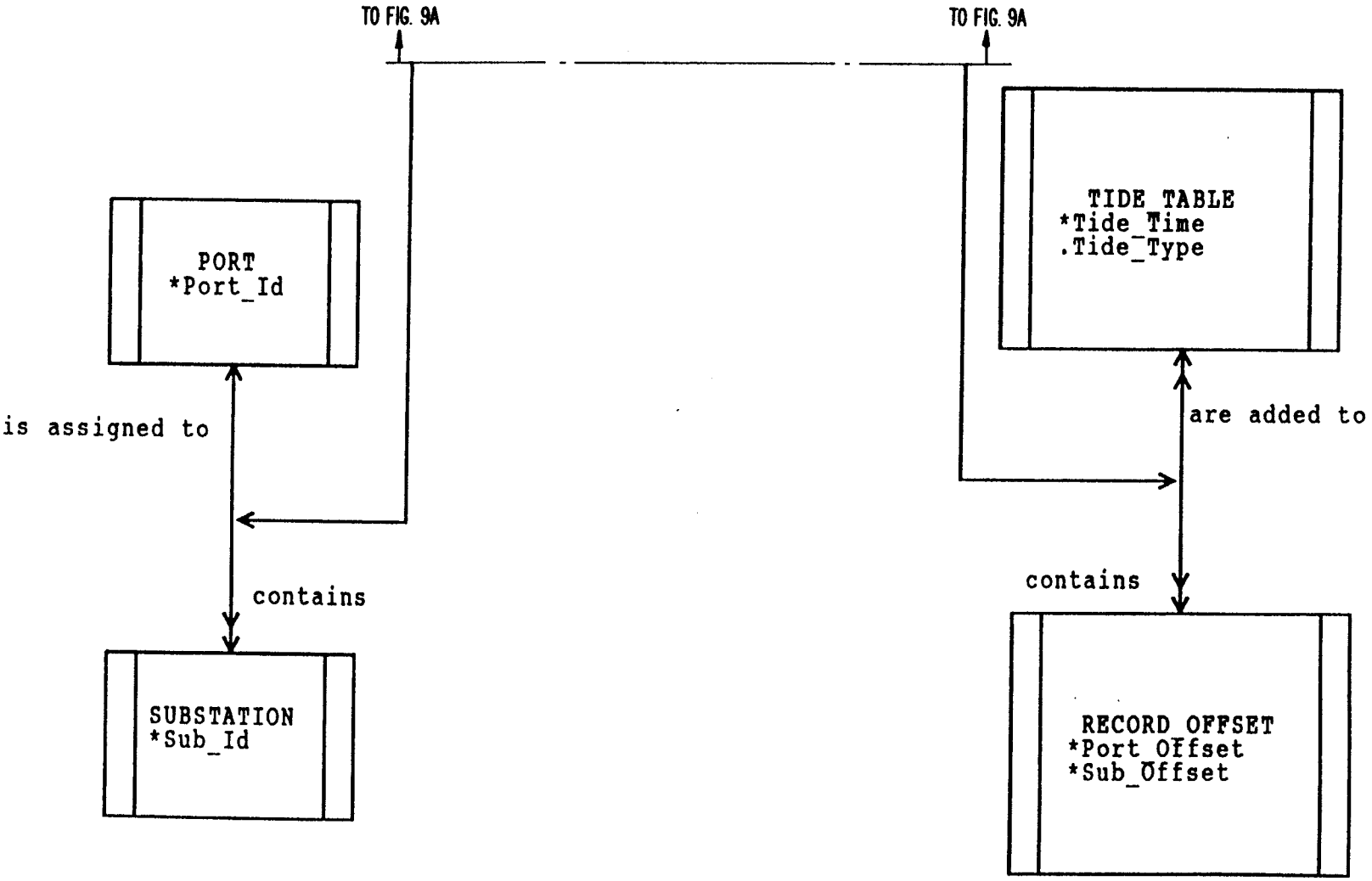

FIG. 9 is an entity relationship diagram which illustrates the relationships between the Tidal Event, Location, Port, Substation, Tide Record, Tide Table and Record Offset entities. The Tidal Event consists of Port Id, Sub Id, Tide Time, and Tide Type. The Location block consists of Port Id and Sub Id. The Port block consists of Port Id, while the Substation block consists of Sub Id. The Tide Record block consists of Tide Time and Tide Type. The Tide Table block consists of Tide Time and Tide Type, while the Record Offset block consists of Port Offset and Sub Offset.

Figure 10:
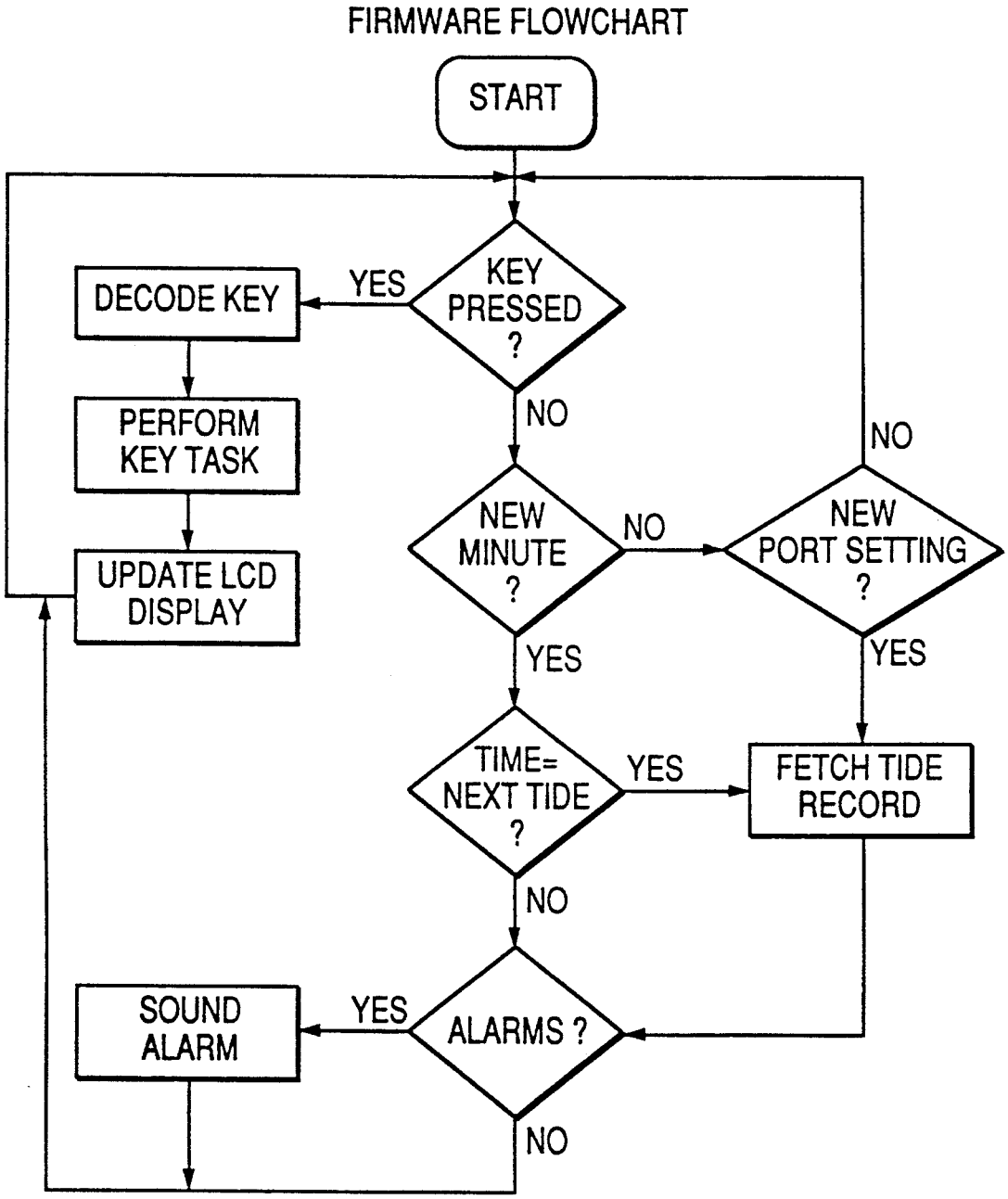
FIG. 10 is a firmware flow chart of an embodiment of the invention.

A flowchart of the device firmware program for one embodiment is shown in FIG. 10. The program is entered at the Start block. The first decision block is labeled "Key Pressed?" The device is checking to see if the user has pressed a key indicating a desired task or mode of operation. If no key has been pressed, the program flows downward to the next decision block, labeled "New Minute?" If a key has been pressed, then the program goes to the function blocks "Decode Key, Perform Key Task, and Update LCD Display" and then returns to the "Key Pressed?" decision block.

If the "New Minute?" test is true, then the flow continues downward to the "Time=Next Tide?" decision block. If the "New Minute?" test is false, flow goes to the right to decision block "New Port Setting?" If the "New Port Setting?" test is false, the flow returns to the "Key Pressed?" decision block. If the "New Port Setting?" test is true, then the function "Fetch Tide Record" is performed and flow goes to the "Alarms?" decision block. When the "New Minute?" test is true and flow proceeds to the "Time=Next Tide?" decision block, then if the "Time=Next Tide?" test is false, flow proceeds to the "Alarms?" decision block. If the "Time=Next Tide?" test is true, flow precedes to the "Fetch Tide Record" block and then to the "Alarms?" decision block.

If the test for "Alarms?" is false, then flow returns to the "Key Pressed?" decision block. If the test for "Alarms?" is true, then an alarm is sounded, as indicated by the "Sound Alarm" function block, and flow the returns to the "Key Pressed?" decision block.

DATA COMPRESSION SCHEME

Figure 14:
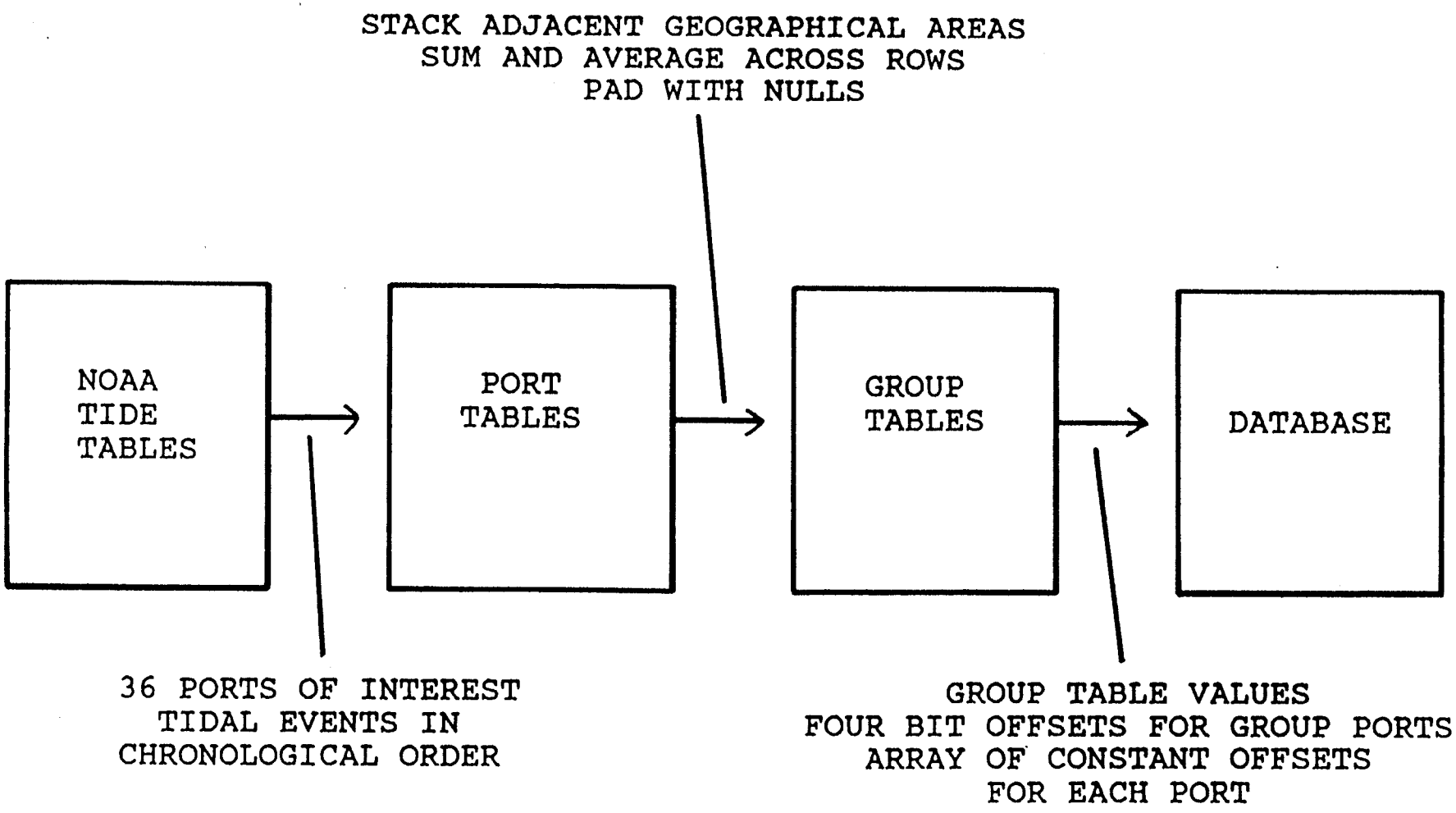
FIG. 14 is a block diagram of the database construction process.

FIG. 14 shows how the compaction of NOAA Tide Tables is done, according to one aspect of the present invention, in block diagram form. This method of compressing the port and tide data came about in determining the hardware requirements for different embodiments of the present invention. A study was undertaken in an effort to determine the minimum amount of memory required to store the Tidal Tables for 36 ports located in the continental United States (see FIG. 11). For each of these 36 ports there are also substations which experience the same tidal events but at a constant time offset from the referenced port. The required accuracy for the device database was determined to be to the nearest ten minutes of the actual time of the event by analysis of U.S. Government Tidal Tables.

For the year 1989, there were 48,798 total tides for the 36 ports of interest. They ranged from a low of one per day to a high of five per day. The number of tides per year for the individual ports ranged from a low of 751 to a high of 1411 tides per year.

Figure 12:
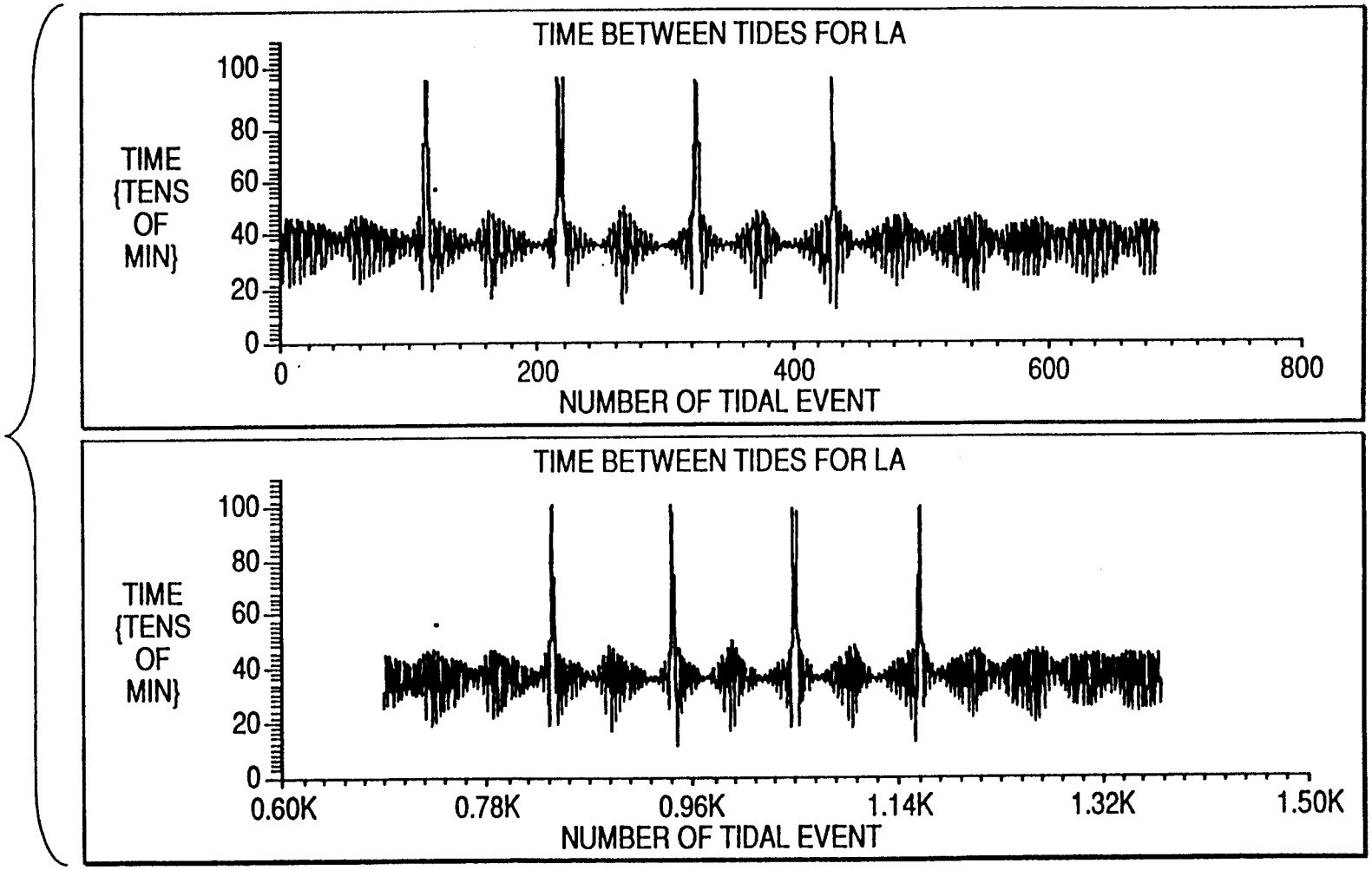
FIG. 12 is a graph of time between tides for L.A.
Figure 13:
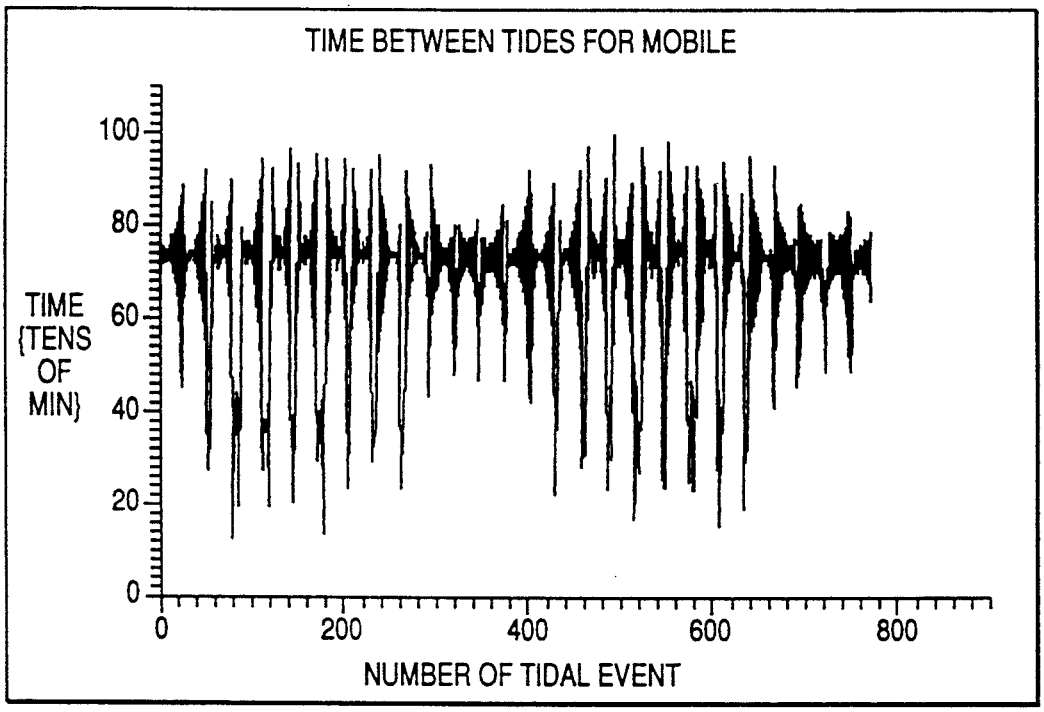
FIG. 13 is a graph of time between tides for Mobile.

FIG. 11 lists the 36 ports and the maximum, minimum, and average time between tides in units of tens of minutes. Due to the large fluctuation in the time between tides (see the graphs in FIGS. 12 and 13) as experienced by some ports it is impossible to compress the data in a vertical direction where the final form does not require a minimum of one byte of memory per tidal event. Any scheme that tags a tidal event with a time of day stamp will also require a minimum of one byte per tidal event. With a total of 48,798 tides this equates to a minimum of 48,798 bytes to encode the tidal tables for the 36 ports.

Examination of the tide tables for ports located in adjacent geographical areas showed that a high degree of similarity exits for ports which border the same body of water. It was while examining these marked similarities that the Group Table concept was developed. The driving force behind the Group Table concept was the idea of a generic tidal table that was a close match for geographically adjacent ports. Using this table, the actual tidal event times for the various ports could be represented as a four bit offset from the generic table. The Group Table (generic table) is in the format of a list of word (two byte) entries where each entry is the time for a tidal event in "tens of minutes" from the start of the year. Since there are 525,600 minutes in a year, this means that the largest entry in the table is restricted to 52,560, which is well within the maximum range of a word (two byte) integer, which can represent a number as high as 65,535. This format also facilitates the handling of time in respect to addition, subtraction, and comparison operations by reducing these operations to simple integer arithmetic. For the year 1989, there was a maximum of 1411 tidal events for any one port. This results in a table of size 2822 bytes (1411 * 2).

The Group Table is constructed using Port Tables which are created from the data files supplied by the U.S. government. These Port Tables are constructed in the same format as the Group Table where all the tidal events are listed in chronological order in units of "tens of minutes" from the start of the year. The Port Tables for a geographical adjacent area are stacked in adjacent columns and then summed and averaged across the rows to construct the Group Table.

For the Group Table scheme to work, there is a constant byte offset associated with each port that references a Group Table. The purpose of this offset is to shift the respective port table up and down so that it is in alignment with the Group Table resulting in 4 bit offsets.

The final form of the database utilizing the Group Table consists of a column holding the Group Table values with a row of four bit offsets for the ports which comprise the group, and an array of constant offsets for each of the ports in the group. To determine the tidal event for a particular port for a given day you simply scan the Group Table column until you find the generic entry for the time in question, then traverse the row associated with that column until you find the four bit offset for the port in question. Add the four bit offset and the port constant offset to the value from the Group Table column and you have the tidal time for that port.

However, experimentation with the Group Table concept yielded some interesting results. It was found that most of the ports on the Eastern Seaboard could be consolidated in one Group Table. Specifically 21 ports (the first 21 entries in FIG. 11) were successfully combined and referenced to a generic Group Table with a four bit offset. This resulted in a total memory requirement of 18364 bytes $\{(1411 * 2)+(1411 * 21 * 0.5)+211$ with half a byte wasted per table entry. Four ports on the West Coast were also successfully grouped but this results in no net savings in memory as a four port group utilizing a Group Table with four bit offsets for the ports equates to one byte per tidal event of memory storage.

It was subsequently discovered that due to the large fluctuations in tides for the Gulf Coast and remaining West Coast ports that it was impossible to consolidate these ports into Group Tables with four bit port offsets.

In an effort to conserve memory, the possibility of eliminating the Group Table and replacing it with a Port Table was investigated. It was discovered that due to the strong similarity in the East Coast group, that virtually any of the East Coast ports could be used as the Group Table and the other 20 ports would still be aligned within a four bit offset. Hampton, Va. was then substituted as the Group Table, due to its geographic location in the center of the East Coast. Since the tidal information for Hampton was now encoded in the Group Table, the four bit offset for Hampton could be eliminated. This resulted in a savings of 706 bytes. Further examination showed that one of the four West Coast groups could be incorporated in the East Coast group using a 4 bit offset, and that six other stations could be included using a 5 bit offset. At this time 28 of the ports were incorporated into a table requiring 24015 bytes of memory with three quarters of a byte wasted for each table entry.

The ports included in the group at this time had all shared a common characteristic. They all had 1410 to 1411 tidal events per year while the remaining 8 ports had tide totals ranging from 751 to 1405. To be included in the group the remaining ports would have to be padded with null entries so that they would be in alignment with the Group Table. A program was developed that would take the Port Tables from these ports and align them by padding the Port Table with null records so that the tidal events would be in alignment across the rows with the Group Table entry nearest in value. Checking these adjusted ports against the Group Table showed that 4 of the ports could be included in the table with 6 bit offsets, and the other four ports could be included with 7 bit offsets. All offsets in the group are signed, so it is possible to mark a port offset which corresponds to a null record with −0, thereby indicating that no tide event exists for this port corresponding to this Group Table entry.

The database now contained all 36 ports of interest. The table used for storage and retrieval of the tidal data had the following format:

| Table Entry | 16 Bits |
|---|---|
| 21 * (4 Bit Offsets) | 84 Bits |
| 6 * (5 Bit Offsets) | 30 Bits |
| 4 * (6 Bit Offsets) | 24 Bits |
| 4 * (7 Bit Offsets) | 28 Bits |

Each table entry contains a total of 182 bits which requires 23 bytes with 2 bits available for future needs. This results in a total memory requirement of 32453 bytes plus 35 bytes for the constant port offsets leaving 280 bytes free for initialization parameters for the database.

This scheme does not leave room in a 32k byte memory for storage of substation offsets. However, these offsets can be stored in program memory due to the relative consistency of the substation offsets from year to year, so that in one configuration, 32K bytes of memory is used to provide a full year of tide prediction capability. In another preferred embodiment, up to three years of tide prediction data is provided with a memory proportionally larger.

It will be understood that the above description of the present invention is susceptible to various modifications, changes, and adaptations, and the same are intended to be comprehended within the meaning and range of equivalents of the appended claims.

What is claimed:

1. In a programmable microprocessor based tidal information calculating the displaying device, having memory for storing program code and tidal information input means for entering data and selecting functions, and display means for displaying at least port and tidal information, a custom port tide prediction method comprising the steps of:

pre-storing in the memory a data base of known tide data for a plurality of ports, at least one of which ports is adjacent to a desired port;

inputting with the input means observed or measured tide offset data for a desired port, the offset data being relative to said at least one adjacent port of said plurality of stored ports, said offset data being at least one of a time of a high tide at said desired port relative to said adjacent port, a time of a low tide at said desired port relative to said adjacent port, a height of a high tide at said desired port relative to said adjacent port and a height of a low tide at said desired port relative to said adjacent port;

producing with the microprocessor and storing in the memory, custom port data for said desired port as a combination of said tide offset data for said desired port and the tide data associated with said at least one adjacent port; and producing with the microprocessor using said custom port data stored in the memory and displaying on the display means, tidal information for the desired port, in response to inputting with the input means a request for tidal information for the desired port.

2. The method according to claim 1, wherein said observed or measured offset data associated with said desired port comprises a time of a high tide at said desired port relative to said adjacent port, a time of a low tide at said desired port relative to said adjacent port, a height of a high tide at said desired port relative to said adjacent port and a height of a low tide at said desired port relative to said adjacent port.

3. In a tide prediction system comprising a user interface, processor means for performing data processing, and memory means for storage of tidal data for a plurality of ports and program information for use by said tide prediction system, a method of performing a custom port mode of operation upon command from a user comprising the steps of:

retrieving, with the processor means from the memory means, tidal data for a port adjacent to a desired port;

receiving, an input to the processor means from the user interface, observed or measured offset data associated with said desired port;

producing custom port information with the processor means and storing, in the memory means, the custom port information, produced by the processor means, the custom port information being produced based on the retrieved tidal data and the input offset data; and producing with the processor means, and displaying on said user interface, tidal event data for said desired port, the tidal event data being based on the stored custom port information.

4. The method according to claim 3, wherein said observed or measured offset data associated with said desired port comprises a time of a high tide at said desired port relative to said adjacent port, a time of a low tide at said desired port relative to said adjacent port, a height of a high tide at said desired port relative to said adjacent port and a height of a low tide at said desired port relative to said adjacent port.

5. The method according to claim 3, wherein said observed or measured offset data associated with said desired port comprises at least one of a time of a high tide at said desired port relative to said adjacent port, a time of a low tide at said desired port relative to said adjacent port, a height of a high tide at said desired port relative to said adjacent port and a height of a low tide at said desired port relative to said adjacent port.

6. In a tide watch for displaying port tide table data for a plurality of ports, which data includes at lest a port code and the date and time of high and low tides, the tide watch including programmable processor means for performing data processing and controlling the operation of the tide watch, memory means for storing program code and data, input means for inputting to the tide watch data and function request from a user of the tide watch, and display means for displaying to the user data associated with the requests input with the input means, a method of storing and retrieving the port tide table data under the control of the processing means comprising the steps of:

storing, with the processor means in the memory means, a port code for each of the plurality of ports, and storing, in the memory means, a port code for a custom desired port which port is adjacent to one of said stored ports;

storing, with the processor means in the memory means, associated tide data corresponding to at least the date, time and type of tide, and storing, in the memory means, observed or measured tidal offset data for said custom desired port relative to an adjacent one of said stored ports;

retrieving, with the processor means from the memory means, tide data associated with a desired port in response to inputting with the input means a port code and a desired data and time by a user of the tide watch;

displaying, on the display means, the retrieved tide data, including at least the port code, the desired date and time, and the type, high or low, of a next tide;

graphically displaying, on the display means, the water level associated with the retrieved tide data relative to the time interval between the next and previous high and low tide extremes;

in response to inputting of said port code for said custom desired port and a date and time, displaying, on the display means under control of the processor means, date and time and the type, high or low, of a next tide for said desired custom port.

7. The method of claim 6 further comprising generating, under control of the processor means with the display means, an alarm upon the occurrence of the next tide.

8. The method of claim 6, further comprising the step of:

scrolling, under control of the processor means on the display means, through subsequent tide data associated with the desired port and time upon command from the user with the input means.

9. The method of claim 8, wherein:

said step of retrieving tide data associated with a desired port in response to inputting of a port code and a desired date and time by a user of the tide watch includes using, by the processor means, the port code to locate associated tide data stored in the memory means; and said step of scrolling through subsequent tide data associated with the desired port upon command from the user includes retrieving, with the processor means from the memory means, tide data for a subsequent high or low tide.

10. The method of claim 6 further comprising graphically displaying, on the display means, the water level associated with the displayed tide data for said desired customer port, under control of the processor means.

11. The method according to claim 6, wherein the watch further includes a user interface and timing means for producing time signals, the method further comprising the steps of:

(1) performing a normal watch mode of operation with the timing means, until commanded by a user through the user interface to operate the watch to scroll through and enter a plurality of other modes of operation including a set port mode of operation, a tide watch mode of operation, a customer port mode of operation, an alarm clock mode of operation, a stop watch mode of operation, a set time mode of operation, said normal watch mode of operation being returned to upon exiting any of the other modes of operation, upon command from a user;

(2) controlling, with the processor means, entrance to and exit from the plurality of modes of operation upon command from a user through the user interface;

(3) controlling, with the processor means, the displaying on the user interface of the current mode of operation of the watch as well as information and user prompts associated with said current mode of operation, said information including phases of the moon, current water height, current port, time of the next tide, time of the last tide, current time and date, and alarm and stop watch indications, upon command from a user through the user interface;

(4) changing, with the processor means, stored information in the memory means, including time and port information displayed on the user interface and associated with the current mode of operation, upon command from a user through the user interface;

(5) entering, storing and recalling user selected data from said memory means as needed to perform steps (1) through (4);

(6) controlling the watch with the processor means to cause an alarm signal to be output to the user through the user interface upon detecting of an alarm time.

12. The method of claim 11 wherein said step of causing an alarm includes producing an alarm upon the determination by the processor means of the occurrence of the time of the next tide for the current port.

13. The method according to claim 6, wherein said observed or measured tidal offset data associated with said custom desired port comprises at least one of a time of a high tide at said custom desired port relative to said adjacent one of said stored ports, a time of a low tide at said custom desired port relative to said adjacent one of said stored ports, a height of a high tide at said custom desired port relative to said adjacent port and a height of a low tide at said custom desired port relative to said adjacent port.

14. Tide prediction apparatus comprising:

a memory for storing a database of tidal event data;

a liquid crystal display for displaying information to a user of said apparatus; and a processor means for performing a custom port function by retrieving tidal event data from said memory associated with a know port, storing input observed or measured offset data from a user into said memory, calculating custom port tidal data from the known tidal event data and the user input offset data, and causing the calculated custom port tidal data be displayed on said display.

15. In a tide prediction watch comprising:

memory means for storing port tide table data;

mode selection means for selecting one of a plurality of modes of operation of the tide prediction watch;

input means for inputting an address to identify a desired port and a desired data;

processor means for performing functions associated with said plurality of modes of operation, including retrieving port tide table data and processing it in accordance with a selected mode of operation and the input data; and display means for displaying information to a user, the information including processed port tide table data, the improvement wherein one of said plurality of modes of operation is a customized port mode and said processor means includes means, responsive to an input address identifying a customized port, for producing customized port tide data for a user specified port, not previously stored in said memory means, based on port tide table data stored in said memory means and a user supplied observed or measured offset fed in via said input means.

16. The tide prediction watch of claim 15 wherein said display means is responsive to said processor means to display the time of the next tide on the desired date and the current water level for the port corresponding to the input address from the user via the input means.

17. In a tide watch for displaying tide table data for a plurality of ports, which data includes at least a port code and the date and time of high and low tides, a system for storing and retrieving the port tide table data comprising:

(1) means for storing a port code for each of the plurality of ports;

(2) means for storing associated tide data corresponding to at least the date, time and type of tide, for first selective ones of the plurality of ports, said first selective ones being major ports;

(3) means for storing of set data for second selective ones of the plurality of ports, said second selective ones being substation ports;

(4) means for receiving, an input from a user of the tide watch, a port code and a desired date, the input port code including a major port field and a substation field;

(5) means for retrieving and displaying tide data associated with a desired port in response to the user input to the means for receiving including:

(a) means for retrieving and displaying stored tide data directly, activated if the input port code is associated with a major port; and (b) means for retrieving tide data associated with an adjacent major port, means for finding the appropriate offset data, means for forming a result by combining the found offset data with the retrieved tide data, and means for displaying the formed result, activated if the input port code is associated with a substation port.

18. A tide prediction system comprising:

(A) a user interface including:

(1) mode means for scrolling through a plurality of modes of operation including a normal watch mode of operation, a set port mode of operation, a tide watch mode of operation, a custom port mode of operation, an alarm clock mode of operation, a stop watch mode of operation, a set time mode of operation, said normal watch mode of operation being returned to upon exiting any of the other modes of operation;

(2) adjust means for controlling entrance and exit from the plurality of modes of operation;

(3) display means for displaying the current mode of operation of the watch system, as well as information and user prompts associated with said current mode of operation, said information including phases of the moon, current relative water height, current port, time of the next tie, time of the last tide, current time and date, and alarm indications;

(4) toggle means for changing the time and port information displayed by said display means, and for changing the setting of displayed information associated with the mode of operation;

(5) memory switch means for entering and recalling user selected data;

(6) alarm means for causing an alarm signal to be output to the user;

(B) memory means for storage of data and program information for use by said tide prediction system, the data including at least tidal event data; and (C) processor means, connected to said memory means and responsive to signals from said user interface, for performing data processing including performing the corresponding operation upon entry to one of said modes of operation; wherein said display means includes:

means for displaying a set time and set port prompt wherein activation of said adjust means during the display of said set time and set port prompt causes entry to said custom port mode of operation and wherein subsequent activation of said adjust means causes exit from said custom port mode of operation;

means for displaying offset values to allow a user to select either a plus or minus observed or measured offset value of time and/or height for high and/or low tides by activation of said toggle means during display of said offset values to increment the displayed value, by activation of said mode means to select desired values, and by activation of said memory switch means to store selected high and low tide time and height of set values for a custom port; and means for displaying custom port information containing a changes substation field appended to a major port field, said changed substation field being automatically incremented each time a custom port is selected and stored.

19. The tide prediction system of claim 18, wherein said display means includes:

means for displaying the current date, time and day of the week in said normal watch mode of operation;

means for displaying the current relative water height;

means for displaying the current moon phase, and whether it is waxing or waning, associated with the date and time of day displayed;

and wherein activation of said toggle means, during said normal watch mode of operation, causes scrolling of said information displayed to show either the time and type of the next tide, the time and type of the last tide, or the current port setting, and further causes said means for displaying the current relative water height to graphically display the water height associated with the information displayed;

and wherein activation of said memory switch means, during said normal watch mode of operation, operates to replace the current port with a port previously stored in said memory means and display the new port selected and tidal event data associated therewith, each time it is activated, so that repeated activation of said memory switch means results in scrolling on said display means through the other ports stored in said memory means.

20. The tide prediction system of claim 18, wherein said display means includes:

means for displaying a set port prompt wherein, activation of said adjust means during the display of said set port prompt, causes entry to said set port mode of operation and wherein subsequent activation of said adjust means causes exit from said set port mode of operation; and means for displaying the current port to allow the user to adjust the current port setting by activation of said toggle means and said mode means in said set port mode of operation; and wherein activation of said memory switch means, during said set port mode of operation, operates to store the port currently displayed into said memory means.

21. The tide prediction system of claim 18, wherein said display means includes:

means for displaying a tide watch prompt wherein activation of said adjust means during the display of said set port prompt causes entry to said tide watch mode of operation and wherein subsequent activation of said adjust means causes exit from said tide watch mode of operation;

means for displaying the date and time of a next tie for a current port to allow the user to adjust the setting of the date by activation of said mode means during display of said date and time of the next tide; and means for displaying the times and type, high or low, of sequential tidal events and the associated moon phase for a current port upon activation of said toggle means during said tide watch mode of operation.

22. The tide prediction system of claim 18, wherein said display means includes:

means for displaying a set alarm prompt wherein activation of said adjust means during the display of said set alarm prompt causes entry to said set alarm mode of operation and wherein subsequent activation of said adjust means causes exit from said set alarm mode of operation;

means for displaying a time alarm icon to allow a user to select a set alarm time function by activating said toggle means;

means for displaying an alarm time upon activation of said mode means after said time alarm icon has been selected, whereupon said alarm time is incremented by activation of said toggle means, and selected by subsequent activation of said mode means;

means for displaying an hour chime icon so that a user can enable or disable a time alarm by activating said toggle means to display said hour chime icon and activating said mode means during display of said hour chime icon;

means for displaying a tide alarm icon so that a user can enable or disable a change of tide alarm by activating said toggle means to display said tide alarm icon and activating said mode means during display of said tide alarm icon.

23. The tide prediction system of claim 18, wherein said display means includes:

means for displaying a stop watch prompt wherein activation of said adjust means during the display of said stop watch prompt caused entry to said stop watch mode of operation and wherein subsequent activation of said adjust means causes exit from said stop watch mode of operation;

means for displaying an elapsed time counter wherein activation of said mode means alternatively starts and stops the elapsed time counter and activation of said toggle means resets the elapsed time counter.

24. The tide prediction system of claim 18, wherein said display means includes:

means for displaying a set time prompt wherein activation of said adjust means during the display of said set time prompt causes entry to said set time mode of operation and wherein subsequent activation of said adjust means causes exit from said set time mode of operation;

means for displaying standard and military time format fields to allow a user to select one of military and standard time format by activation of said toggle means to indicate on of the fields, followed by activation of said mode means to select on of the formats;

means for displaying month, date, hour and minute values, wherein activation of said toggle means during display increments, and activation of said mode means during display selects, a desired value;

means for displaying a first year of which corresponding tidal data is currently stored in said tide prediction system to allow a user to modify said first year to a current year by activation of said toggle means to increment and said mode means to select;

means for displaying a daylight saving time icon to allow a user to select a daylight savings time mode of time keeping by using said toggle means to indicate and said mode means to select.

* * * * *

UNITED STATES PATENT AND TRADEMARK OFFICE

CERTIFICATE OF CORRECTION

PATENT NO. : 5,293,355
DATED : March 8, 1994
INVENTOR(S) : Widen, Randy M. and Stiles, Lance It is certified that error appears in the above-identified patent and that said Letters Patent is hereby corrected as shown below:

Column 28
Line 40, delete “the” and substitute therefore -- and --.
Line 41, after the words “tidal information”, insert -- , --.

Column 29,
Line 52, delete “lest” and substitute therefore -- least --.

Column 30,
Line 60, delete “customer” and substitute therefore -- custom --.

Column 31,
Line 45, delete “know” and substitute therefore -- known --.
Line 50, after the word “data”, insert -- to --.

Column 32,
Line 60, delete “tie” and substitute therefore -- tide --.

Column 34,
Line 16, delete “tie” and substitute therefore -- tide --.

Signed and Sealed this

Twelfth Day of October, 2004

JON W. DUDAS
*Director of the United States Patent and Trademark Office*